US008010348B2

(12) United States Patent
Son et al.

(10) Patent No.: US 8,010,348 B2
(45) Date of Patent: Aug. 30, 2011

(54) ADAPTIVE ENCODING AND DECODING WITH FORWARD LINEAR PREDICTION

(75) Inventors: Chang-yong Son, Gunpo-si (KR); Eun-mi Oh, Seongnam-si (KR); Ki-hyun Choo, Seoul (KR); Jung-hoe Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1032 days.

(21) Appl. No.: 11/774,664

(22) Filed: Jul. 9, 2007

(65) Prior Publication Data

US 2008/0010062 A1 Jan. 10, 2008

(30) Foreign Application Priority Data

Jul. 8, 2006 (KR) ..... 10-2006-0064148
Jun. 25, 2007 (KR) ..... 10-2007-0062294

(51) Int. Cl.
*G10L 19/02* (2006.01)
*G10L 19/04* (2006.01)
*G10L 19/08* (2006.01)

(52) U.S. Cl. ..... 704/203; 704/205; 704/219; 704/500

(58) Field of Classification Search ..... 704/203, 704/205, 219, 500, 221, 230; 370/465
See application file for complete search history.

(56) References Cited

U.S. PATENT DOCUMENTS 5,206,884 A * 4/1993 Bhaskar ..... 375/254
5,632,003 A * 5/1997 Davidson et al. ..... 704/200.1
5,710,863 A * 1/1998 Chen ..... 704/200.1
5,752,225 A * 5/1998 Fielder ..... 704/229
6,327,562 B1 * 12/2001 Proust ..... 704/219
6,363,338 B1 * 3/2002 Ubale et al. ..... 704/200.1
6,408,267 B1 * 6/2002 Proust ..... 704/210
6,633,841 B1 * 10/2003 Thyssen et al. ..... 704/233
7,498,959 B2 * 3/2009 Lee et al. ..... 341/70
7,624,022 B2 * 11/2009 Son et al. ..... 704/503
7,630,396 B2 * 12/2009 Goto et al. ..... 370/464
7,664,633 B2 * 2/2010 Den Brinker et al. ..... 704/206
7,864,843 B2 * 1/2011 Choo et al. ..... 375/240.12
2004/0024588 A1 * 2/2004 Watson et al. ..... 704/200.1
2004/0024597 A1 * 2/2004 Adut ..... 704/233
2007/0208565 A1 * 9/2007 Lakaniemi et al. ..... 704/268

(Continued)

OTHER PUBLICATIONS

EP Search Report issued Mar. 29, 2011 in EP Application No. 07768630.1.

(Continued)

*Primary Examiner* — Martin Lerner
(74) *Attorney, Agent, or Firm* — Stanzione & Kim, LLP

(57) ABSTRACT

An adaptive encoding method includes splitting an input signal into a low-frequency band signal and a high-frequency band signal; performing forward adaptive linear prediction on the low-frequency band signal and thus filtering the low-frequency band signal; selectively performing backward adaptive linear prediction or long-term prediction on the filtered low-frequency band signal according to the analysis result of the low-frequency band signal; transforming the low-frequency band signal, on which backward adaptive linear prediction or long-term prediction has been performed, into a signal in a frequency domain and quantizing the signal; and encoding the high-frequency band signal using the low-frequency band signal, on which backward adaptive linear prediction or long-term prediction has been performed, or the quantized signal. Therefore, compression efficiency of both speech and music signals can be enhanced, and a robust compression method can be provided for various audio contents at a low bit rate.

33 Claims, 10 Drawing Sheets

U.S. PATENT DOCUMENTS

| | | | | |
|---|---|---|---|---|
| 2007/0282599 | A1* | 12/2007 | Choo et al. | 704/205 |
| 2007/0299656 | A1* | 12/2007 | Son et al. | 704/205 |
| 2007/0299669 | A1* | 12/2007 | Ehara | 704/262 |
| 2009/0271204 | A1* | 10/2009 | Tammi | 704/500 |

OTHER PUBLICATIONS

Schnitzler J. et al.: "Wideband speech coding using forward/backward adaptive prediction with mixed time/frequency domain excitation", Speech Coding Proceedings, 1999 IEEE Workshop on Porvoo, Finland 20-23 Jun. 1999, Piscataway, NJ, USE, IEEE, US, Jun. 20, 1999, pp. 4-6, XP010345568.

Lefebvre R. et al.: "High quality coding of wideband audio signals using transform coded excitation (TCX)", Proceedings of the international conference on acoustics, Speech, and Signal processing (ICASSP) . Speech processing 1. Adelaide, Apr. 19-22, 1994, [Proceedings of the international conference on acoustics, Speech and Signal processing. (ICASSP)], vol. i., 19 Apr. 1994, pp. 1/193-1/196, XP010133560.

* cited by examiner

ADAPTIVE ENCODING AND DECODING WITH FORWARD LINEAR PREDICTION

CROSS-REFERENCE TO RELATED APPLICATIONS

This application claims the priority of Korean Patent Application No. 10-2006-0064148, filed on Jul. 8, 2006 and No. 10-2007-0062294, filed on Jun. 25, 2007, in the Korean Intellectual Property Office, the disclosure of which is incorporated herein in its entirety by reference.

BACKGROUND OF THE INVENTION

1. Field of the Invention

The present general inventive concept relates to a method and apparatus to encode a speech signal and a music signal and a method and apparatus to decode a speech signal and a music signal.

2. Description of the Related Art

Conventional methods of coding a speech signal and a music signal include a transform coding method, a code excited linear prediction (CELP) coding method, and a hybrid transform and time domain coding method.

The transform coding method compresses a signal by applying a psycho-acoustic model in a frequency domain. Therefore, the quality of a speech signal may deteriorate. On the other hand, the CELP coding method compresses a signal by applying a speech production model in a time domain. Therefore, the quality of a music signal may deteriorate. The hybrid transform and time domain coding method removes temporal redundancy by applying the speech production model in the time domain and then compresses a residual signal in the frequency domain. Therefore, when the hybrid transform and time domain coding method is used, a lower sound quality may be achieved than when the transform coding method or the CELP coding methods is used.

SUMMARY OF THE INVENTION

The present general inventive concept provides an adaptive encoding method and apparatus which can enhance encoding efficiency by adaptively performing an encoding operation according to characteristics of an input signal.

The present general inventive concept also provides an adaptive decoding method and apparatus which can enhance decoding efficiency by adaptively performing a decoding operation according to characteristics of an input signal.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing an adaptive encoding method including splitting an input signal into a low-frequency band signal and a high-frequency band signal, performing forward adaptive linear prediction on the low-frequency band signal and thus filtering the low-frequency band signal, selectively performing backward adaptive linear prediction or long-term prediction on the filtered low-frequency band signal according to the analysis result of the low-frequency band signal, transforming the low-frequency band signal, on which backward adaptive linear prediction or long-term prediction has been performed, into a signal in a frequency domain and quantizing the signal, and encoding the high-frequency band signal using the low-frequency band signal, on which backward adaptive linear prediction or long-term prediction has been performed, or the quantized signal.

The foregoing and/or other aspects and utilities of the present general inventive concept are also achieved by providing a computer-readable recording medium on which a program to execute an adaptive encoding method is recorded, the adaptive encoding method including splitting an input signal into a low-frequency band signal and a high-frequency band signal, performing forward adaptive linear prediction on the low-frequency band signal and thus filtering the low-frequency band signal, selectively performing backward adaptive linear prediction or long-term prediction on the filtered low-frequency band signal according to the analysis result of the low-frequency band signal, transforming the low-frequency band signal, on which backward adaptive linear prediction or long-term prediction has been performed, into a signal in a frequency domain and quantizing the signal, and encoding the high-frequency band signal using the low-frequency band signal, on which backward adaptive linear prediction or long-term prediction has been performed, or the quantized signal.

The foregoing and/or other aspects and utilities of the present general inventive concept are also achieved by providing an adaptive decoding method including inversely quantizing a quantized low-frequency band signal and inversely transforming the inversely quantized low-frequency band signal into a signal in a time domain, synthesizing the result of backward adaptive linear prediction or long-term prediction with the signal in the time domain if an encoding end has performed backward adaptive linear prediction or long-term prediction, synthesizing the result of forward adaptive linear prediction of the encoding end with a signal obtained after the synthesizing of the result of backward adaptive linear prediction or long-term prediction with the signal in the time domain, and decoding a high-frequency band signal using the result of long-term prediction or the result of synthesizing the result of forward adaptive linear prediction of the encoding end with the signal.

The foregoing and/or other aspects and utilities of the present general inventive concept are also achieved by providing a computer-readable recording medium on which a program to execute an adaptive decoding method is recorded, the adaptive decoding method including inversely quantizing a quantized low-frequency band signal and inversely transforming the inversely quantized low-frequency band signal into a signal in a time domain, synthesizing the result of backward adaptive linear prediction or long-term prediction with the signal in the time domain if an encoding end has performed backward adaptive linear prediction or long-term prediction, synthesizing the result of forward adaptive linear prediction of the encoding end with a signal obtained after the synthesizing of the result of backward adaptive linear prediction or long-term prediction with the signal in the time domain, and decoding a high-frequency band signal using the result of long-term prediction or the result of synthesizing the result of forward adaptive linear prediction of the encoding end with the signal.

The foregoing and/or other aspects and utilities of the present general inventive concept are also achieved by providing an adaptive encoding method including performing forward adaptive linear prediction on an input signal and thus filtering the input signal, selectively performing backward adaptive linear prediction or long-term prediction on the filtered signal according to the analysis result of the input signal, and transforming the input signal, on which backward adaptive linear prediction or long-term prediction has been performed, into a signal in a frequency domain and quantizing the signal.

The foregoing and/or other aspects and utilities of the present general inventive concept are also achieved by providing a computer-readable recording medium on which a program to execute an adaptive encoding method is recorded, the adaptive encoding method including performing forward adaptive linear prediction on an input signal and thus filtering the input signal, selectively performing backward adaptive linear prediction or long-term prediction on the filtered signal according to the analysis result of the input signal, and transforming the input signal, on which backward adaptive linear prediction or long-term prediction has been performed, into a signal in a frequency domain and quantizing the signal.

The foregoing and/or other aspects and utilities of the present general inventive concept are also achieved by providing an adaptive decoding method including inversely quantizing an input signal quantized by an encoding end and inversely transforming the inversely quantized signal into a signal in a time domain, synthesizing the result of backward adaptive linear prediction or long-term prediction with the signal in the time domain if the encoding end has performed backward adaptive linear prediction or long-term prediction, and synthesizing the result of forward adaptive linear prediction of the encoding end with a signal obtained after the synthesizing of the result of backward adaptive linear prediction or long-term prediction with the signal in the time domain.

The foregoing and/or other aspects and utilities of the present general inventive concept are also achieved by providing a computer-readable recording medium on which a program to execute an adaptive decoding method is recorded, the adaptive decoding method including inversely quantizing an input signal quantized by an encoding end and inversely transforming the inversely quantized signal into a signal in a time domain, synthesizing the result of backward adaptive linear prediction or long-term prediction with the signal in the time domain if the encoding end has performed backward adaptive linear prediction or long-term prediction, and synthesizing the result of forward adaptive linear prediction of the encoding end with a signal obtained after the synthesizing of the result of backward adaptive linear prediction or long-term prediction with the signal in the time domain.

The foregoing and/or other aspects and utilities of the present general inventive concept are also achieved by providing an adaptive encoding apparatus including a band splitting unit to split an input signal into a low-frequency band signal and a high-frequency band signal, a forward adaptive linear prediction (FA-LP) filtering unit to perform forward adaptive linear prediction on the low-frequency band signal and thus filtering the low-frequency band signal, a selective performance unit to selectively perform backward adaptive linear prediction or long-term prediction on the filtered low-frequency band signal according to the analysis result of the low-frequency band signal, a transform encoding unit to transform the low-frequency band signal, on which backward adaptive linear prediction or long-term prediction has been performed, into a signal in a frequency domain and quantizing the signal, and a high-frequency band encoding unit to encode the high-frequency band signal using the low-frequency band signal, on which backward adaptive linear prediction or long-term prediction has been performed, or the quantized signal.

The foregoing and/or other aspects and utilities of the present general inventive concept are also achieved by providing an adaptive decoding apparatus including an inverse quantization/inverse transform unit to inversely quantize a quantized low-frequency band signal and inversely transform the inversely quantized low-frequency band signal into a signal in a time domain, a first synthesis unit to synthesize the result of backward adaptive linear prediction or long-term prediction with the signal in the time domain if an encoding end has performed backward adaptive linear prediction or long-term prediction, a second synthesis unit to synthesize the result of forward adaptive linear prediction of the encoding end with an output of the first synthesis unit, and a high-frequency band decoding unit to decode a high-frequency band signal using the result of long-term prediction or an output of the second synthesis unit.

The foregoing and/or other aspects and utilities of the present general inventive concept are also achieved by providing an adaptive encoding apparatus to include an FA-LP filtering unit to perform forward adaptive linear prediction on an input signal and thus filter the input signal, a selective performance unit to selectively perform backward adaptive linear prediction or long-term prediction on the filtered signal according to the analysis result of the input signal, and a transform encoding unit to transform the input signal, on which backward adaptive linear prediction or long-term prediction has been performed, into a signal in a frequency domain and quantizing the signal.

The foregoing and/or other aspects and utilities of the present general inventive concept are also achieved by providing an adaptive decoding apparatus including an inverse quantization/inverse transform unit to inversely quantize an input signal quantized by an encoding end and inversely transform the inversely quantized signal into a signal in a time domain, a first synthesis unit to synthesize the result of backward adaptive linear prediction or long-term prediction with the signal in the time domain if the encoding end has performed backward adaptive linear prediction or long-term prediction, a second synthesis unit to synthesize the result of forward adaptive linear prediction of the encoding end with a signal obtained after the synthesizing of the result of backward adaptive linear prediction or long-term prediction with the signal in the time domain.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
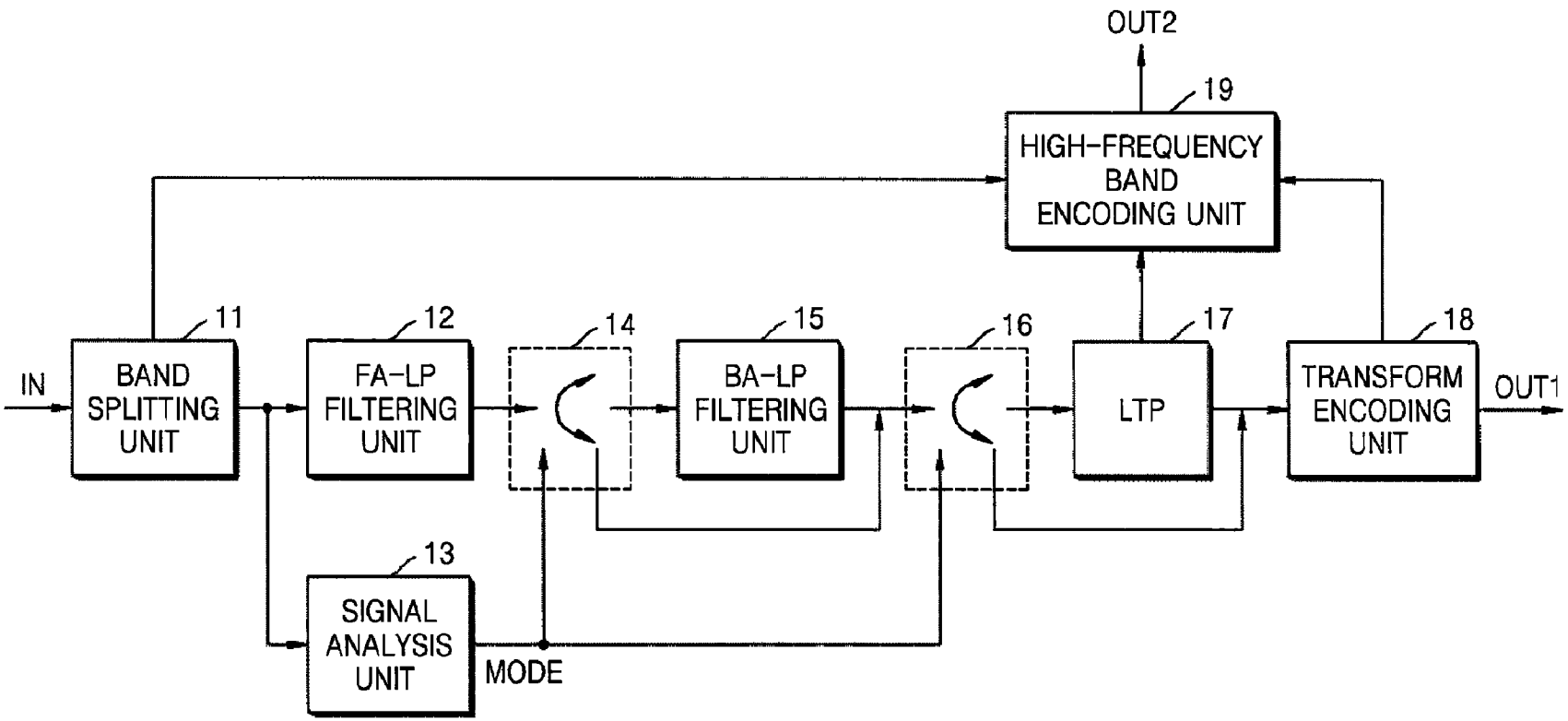
FIG. 1 is a schematic block diagram of an adaptive encoding apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments described herein will hereinafter be described in detail with reference to the accompanying drawings. Like reference numerals in the drawings denote like elements, and thus their description will not be repeated.

FIG. 1 is a schematic block diagram of an adaptive encoding apparatus according to an embodiment.

Referring to FIG. 1, the adaptive encoding apparatus includes a band splitting unit 11, a forward adaptive linear prediction (FA-LP) filtering unit 12, a signal analysis unit 13, a first switching unit 14, a backward adaptive linear prediction (BA-LP) filtering unit 15, a second switching unit 16, a long-term prediction (LTP) unit 17, a transform encoding unit 18, and a high-frequency band encoding unit 19.

The band splitting unit 11 splits an input signal IN into a low-frequency band signal and a high-frequency band signal. The input signal IN may be a pulse code modulation (PCM) signal obtained after an analog speech or audio signal is modulated into a digital signal. The low-frequency band signal may correspond to a frequency lower than an arbitrary threshold value, and the high-frequency band signal may correspond to a frequency higher than the arbitrary threshold value.

The FA-LP filtering unit 12 performs forward adaptive linear prediction on the low-frequency band signal and thus filters the low-frequency band signal. Forward adaptive linear prediction is performed based on past speech samples. When forward adaptive linear prediction is performed, linear predictive coding (LPC) coefficients must be transmitted to a decoding end as additional information.

The linear predictive coding denotes modelling a part of a signal, which corresponds to a formant, i.e., semantic information of speech, and detecting an envelope of the signal. Specifically, the linear prediction coding is a method of approximating a speech signal at a given point of time to a linear combination of past speech signals. Since the linear predictive coding models a value at a given time using past values (generally, smaller values) near the value, it is also referred to as "short-term prediction." As described above, in the linear predictive coding, a current speech sample is predicted from past speech samples, and LPC coefficients, which minimize prediction errors, i.e., the difference between the predicted current speech sample and an original sample, are calculated. Then, long-term prediction is performed on an error signal that passed through a prediction filter, thereby encoding the error signal.

A formant is a resonant frequency generated at vocal cords or a nasal meatus. It is also referred to as a formant frequency. The formant varies according to the geometric shape of the vocal band, and a specified speech signal can be represented by a number of formants. A speech signal may largely be divided into a formant component according to a vocal tract model and a pitch component reflecting tremors of the vocal band. The vocal tract model can be modelled by a linear predictive coding filter, and an error component indicates a pitch component excluding the formant.

The signal analysis unit 13 analyses the low-frequency band signal, determines whether to perform backward adaptive linear prediction and multi-band long-term prediction on the low-frequency band signal, and provides mode information MODE to the first and second switching units 14 and 16.

Specifically, the signal analysis unit 13 may determine whether to perform backward adaptive linear prediction on the low-band frequency band signal according to the degree to which the low-frequency band signal is stationary. For example, if the low-frequency band signal is highly stationary, the signal analysis unit 13 may determine to perform backward adaptive linear prediction on the low-frequency band signal. If not, the signal analysis unit 13 may determine not to perform backward adaptive linear prediction on the low-frequency band signal.

In addition, the signal analysis unit 13 may determine whether to perform backward adaptive linear prediction according to a backward adaptive linear prediction gain value of the low-frequency band signal. For example, if the low-frequency band signal has a high backward adaptive linear prediction gain value, the signal analysis unit 13 may determine to perform backward adaptive linear prediction on the low-frequency band signal.

The signal analysis unit 13 may determine whether to perform multi-band long-term prediction on the low-frequency band signal according to periodicity of the low-frequency band signal for each frequency band. For example, the signal analysis unit 13 may analyse periodicity of the low-frequency band signal for each frequency band and determine to perform long-term prediction on the low-frequency band signal if the low-frequency band signal has strong periodic characteristics.

The first switching unit 14 switches the low-frequency band signal filtered by the FA-LP filtering unit 12 to the BA-LP filtering unit 15 based on the mode information MODE received from the signal analysis unit 13.

The BA-LP filtering unit 15 performs backward adaptive linear prediction on the low-frequency band signal filtered by the FA-LP filtering unit 12 and thus filters the low-frequency band signal. Here, backward adaptive linear prediction is performed based on reconfigured past speech samples, and there is no need to transmit additional information to the decoding end. That is, backward adaptive linear prediction does not require bit transmission and is performed using high-order filter coefficients which were obtained from past signals.

Generally, a spectral envelope of a music signal requires higher spectral resolution than that of a speech signal. Therefore, a lot of bits are required to represent the spectral envelope of the music signal. In order to effectively represent the spectral envelope of the music signal using a small number of bits, backward adaptive linear prediction, which does not require bit transmission to the decoding end, may be performed. If the low-frequency band signal is a speech signal that is not stationary, backward adaptive linear prediction is performed using past signal samples. Therefore, spectral characteristics of a current frame may not be properly reflected. That is, backward adaptive linear prediction can be effectively applied to a section in which the low-frequency band signal is stationary.

For example, if the low-frequency band signal is stationary, the signal analysis unit 13 may determine to perform backward adaptive linear prediction on the low-frequency band signal and provide the mode information MODE to the first switching unit 14. Here, backward adaptive linear prediction is performed on the low-frequency band signal filtered by the FA-LP filtering unit 12 to filter the low-frequency band signal again, thereby reducing the number of bits allocated to an encoding operation.

The second switching unit 16 switches the low-frequency band signal filtered by the FA-LP filtering unit 12 or the low-frequency band signal filtered by the BA-LP filtering unit 15 to the LTP unit 17 based on the mode information MODE received from the signal analysis unit 13.

The LTP unit 17 performs multi-band long-term prediction on the low-frequency band signal filtered by the FA-LP filtering unit 12 or the low-frequency band signal filtered by the BA-LP filtering unit 15 and outputs an excitation signal. Specifically, the LTP unit 17 splits the low-frequency band signal filtered by the FA-LP filtering unit 12 or the low-frequency band signal filtered by the BA-LP filtering unit 15 into a plurality of bands and performs long-term prediction on each band. Then, the LTP unit 17 synthesizes the results of long-term prediction and outputs an excitation signal.

As described above, a pitch prediction gain can be increased using a different pitch gain for each frequency band. Generally, a long-term prediction gain value of a low-frequency band is high, and that of a high-frequency band is low. Therefore, encoding efficiency can be enhanced by applying a different gain value to each frequency band. In addition, while high encoding efficiency can be achieved when long-term prediction is performed on a speech signal, encoding efficiency may deteriorate when long-term prediction is performed on a music signal. Therefore, it is desirable to adaptively perform long-term prediction according to an input signal.

Long-term prediction performed by the LTP unit 17 refers to detecting a pitch component from the low-frequency band signal filtered by the FA-LP filtering unit 12 or the low-frequency band signal filtered by the BA-LP filtering unit 15, extracting the number of past signals corresponding to a pitch lag of the detected pitch component, obtaining the most appropriate period and gain value for a current signal to be analysed, and encoding the current signal using the period and the gain value. As used herein, a pitch denotes a fundamental frequency. The pitch also denotes the most fundamental frequency in a speech signal, that is, a frequency of peaks that appear large on a time axis. The pitch is generated by a periodic tremor of a vocal band. While linear predictive coding is referred to as short-term prediction since it models a value at a given time using past values near the value, long-term prediction is referred to as such since it encodes a current signal to be analysed using past signals before a corresponding pitch period.

The transform encoding unit 18 transforms any one of the low-frequency band signal filtered by the FA-LP filtering unit 12, the low-frequency band signal filtered by the BA-LP filtering unit 15 and the excitation signal output from the LTP unit 17 into a signal in a frequency domain and quantizes the signal using perceptual importance.

The high-frequency band encoding unit 19 encodes the high-frequency band signal using the low-frequency band signal encoded by the transform encoding unit 18 and the result of long-term prediction of the LTP unit 17. For example, the high-frequency band encoding unit 19 may fold the low-frequency band signal into the high-frequency band signal and thus encode the high-frequency band signal.

Figure 2:
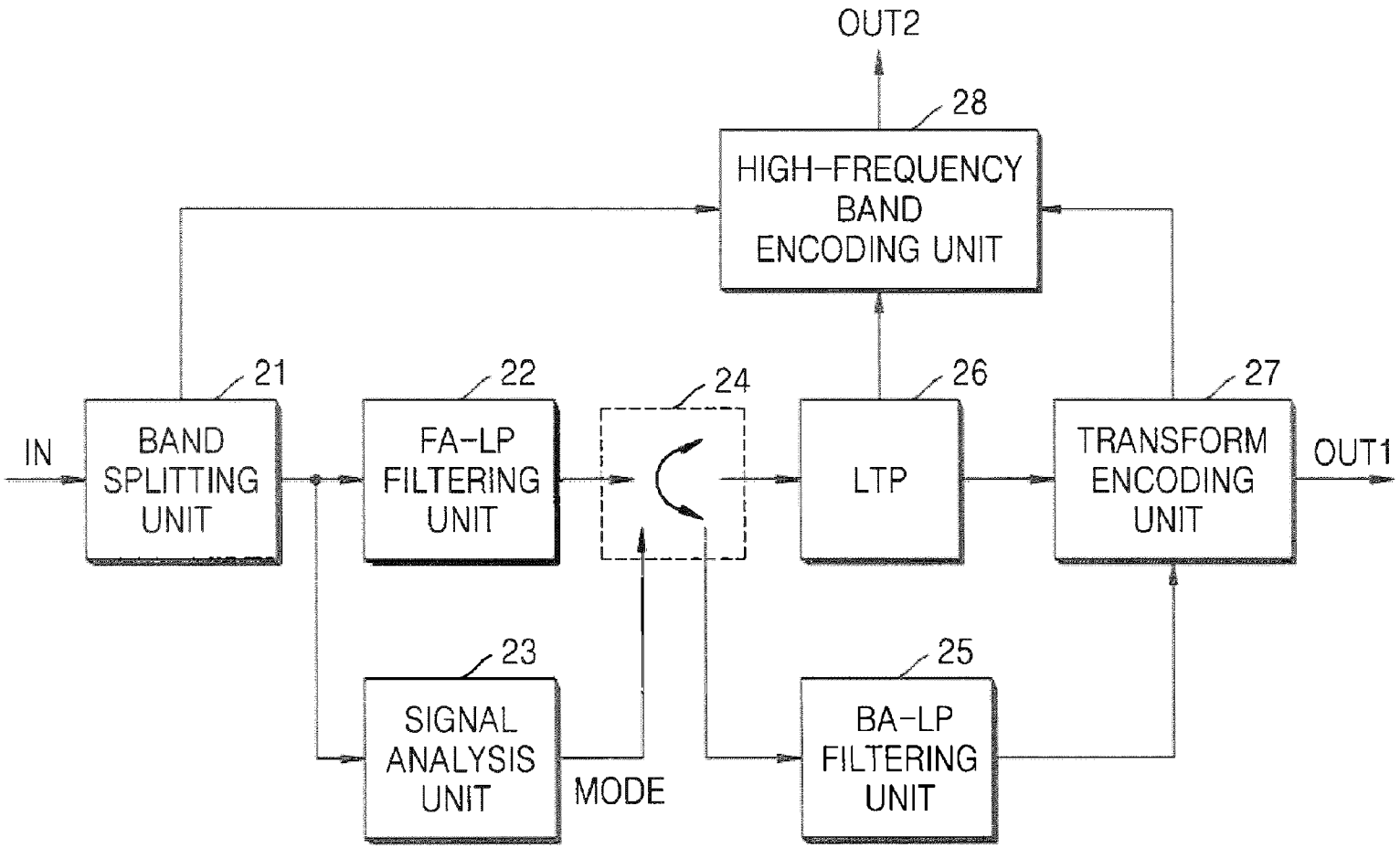
FIG. 2 is a schematic block diagram of an adaptive encoding apparatus according to another embodiment.

FIG. 2 is a schematic block diagram of an adaptive encoding apparatus according to another embodiment.

Referring to FIG. 2, the adaptive encoding apparatus includes a band splitting unit 21, an FA-LP filtering unit 22, a signal analysis unit 23, a switching unit 24, a BA-LP filtering unit 25, an LTP unit 26, a transform encoding unit 27, and a high-frequency band encoding unit 28.

The band splitting unit 21 splits an input signal IN into a low-frequency band signal and a high-frequency band signal. The input signal IN may be a PCM signal obtained after an analog speech or audio signal is modulated into a digital signal. The low-frequency band signal may correspond to a frequency lower than an arbitrary threshold value, and the high-frequency band signal may correspond to a frequency higher than the arbitrary threshold value.

The FA-LP filtering unit 22 performs forward adaptive linear prediction on the low-frequency band signal and thus filters the low-frequency band signal. Forward adaptive linear prediction is performed based on past speech samples. When forward adaptive linear prediction is performed, LPC coefficients must be transmitted to a decoding end as additional information.

The signal analysis unit 23 analyses the low-frequency band signal, determines whether to perform backward adaptive linear prediction and multi-band long-term prediction on the low-frequency band signal, and provides mode information MODE to the switching unit 24.

Specifically, the signal analysis unit 23 may determine whether to perform backward adaptive linear prediction on the low-band frequency band signal according to the degree to which the low-frequency band signal is stationary. For example, if the low-frequency band signal is highly stationary, the signal analysis unit 23 may determine to perform backward adaptive linear prediction on the low-frequency band signal. If not, the signal analysis unit 23 may determine not to perform backward adaptive linear prediction on the low-frequency band signal.

In addition, the signal analysis unit 23 may determine whether to perform backward adaptive linear prediction according to a backward adaptive linear prediction gain value of the low-frequency band signal. For example, if the low-frequency band signal has a high backward adaptive linear prediction gain value, the signal analysis unit 23 may determine to perform backward adaptive linear prediction on the low-frequency band signal.

The signal analysis unit 23 may determine whether to perform multi-band long-term prediction on the low-frequency band signal according to periodicity of the low-frequency band signal for each frequency band. For example, the signal analysis unit 23 may analyse periodicity of the low-frequency band signal for each frequency band and determine to perform long-term prediction on the low-frequency band signal if the low-frequency band signal has strong periodic characteristics.

The switching unit 24 switches the low-frequency band signal filtered by the FA-LP filtering unit 22 to the BA-LP filtering unit 25 or the LTP unit 26 based on the mode information MODE received from the signal analysis unit 23.

When the signal analysis unit 23 determines to perform backward adaptive linear prediction, the BA-LP filtering unit 25 performs backward adaptive linear prediction on the low-frequency band signal filtered by the FA-LP filtering unit 22 and thus filters the low-frequency band signal. Here, backward adaptive linear prediction is performed based on reconfigured past speech samples, and there is no need to transmit additional information to the decoding end. That is, backward adaptive linear prediction does not require bit transmission and is performed using high-order filter coefficients which were extracted from past signals.

For example, if the low-frequency band signal is stationary, the signal analysis unit 23 may determine to perform backward adaptive linear prediction on the low-frequency band signal and provide the mode information MODE to the switching unit 24. Here, backward adaptive linear prediction is performed on the low-frequency band signal filtered by the FA-LP filtering unit 22 to filter the low-frequency band signal again, thereby reducing the number of bits allocated to an encoding operation.

When the signal analysis unit 23 determines to perform long-term prediction, the LTP unit 26 performs multi-band long-term prediction on the low-frequency band signal filtered by the FA-LP filtering unit 22 and outputs an excitation signal. Specifically, the LTP unit 26 splits the low-frequency band signal filtered by the FA-LP filtering unit 22 into a plurality of bands and performs long-term prediction on each band. Then, the LTP unit 26 synthesizes the results of long-term prediction and outputs an excitation signal.

As described above, a pitch prediction gain can be increased using a different pitch gain for each frequency band. Generally, a long-term prediction gain value of a low-frequency band is high, and that of a high-frequency band is low. Therefore, encoding efficiency can be enhanced by applying a different gain value to each frequency band.

The transform encoding unit 27 transforms the low-frequency band signal filtered by the BA-LP filtering unit 25 or the excitation signal output from the LTP unit 26 into a signal in a frequency domain and quantizes the signal using perceptual importance.

The high-frequency band encoding unit 28 encodes the high-frequency band signal using the low-frequency band signal encoded by the transform encoding unit 27 and the result of long-term prediction of the LTP unit 26. For example, the high-frequency band encoding unit 28 may fold the low-frequency band signal into the high-frequency band signal and thus encode the high-frequency band signal.

As described above, the adaptive encoding apparatus can analyse a low-frequency band signal and perform backward adaptive linear prediction and long-term prediction on the low-frequency band signal, as illustrated in FIG. 1. In addition, the adaptive encoding apparatus can analyse a low-frequency band signal and perform any one of backward adaptive linear prediction and long-term prediction, as illustrated in FIG. 2.

Figure 3:
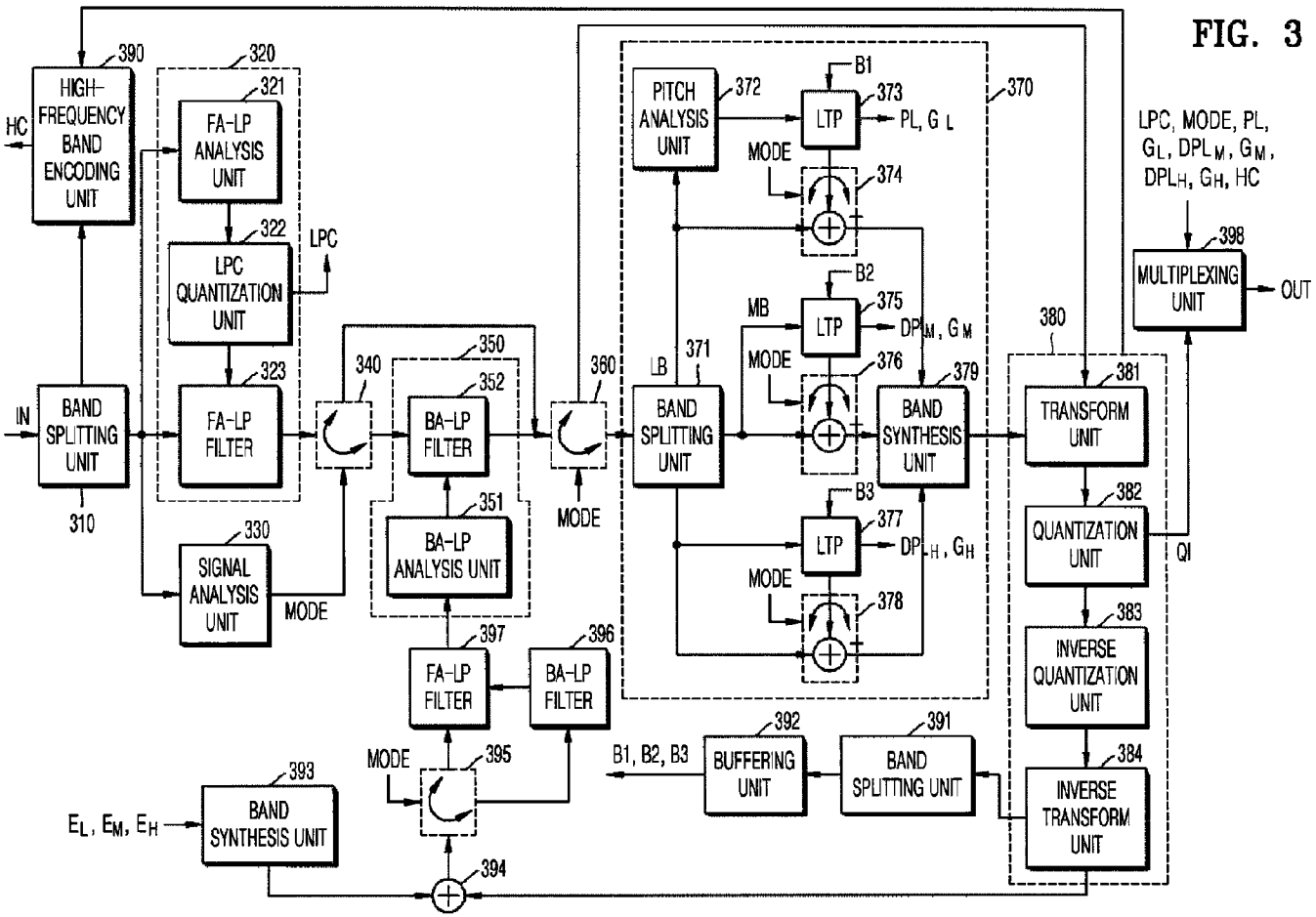
FIG. 3 is a detailed block diagram of the adaptive encoding apparatus illustrated in FIG. 1.

FIG. 3 is a detailed block diagram of the adaptive encoding apparatus illustrated in FIG. 1.

Referring to FIG. 3, the adaptive encoding apparatus includes a first band splitting unit 310, an FA-LP filtering unit 320, a signal analysis unit 330, a first switching unit 340, a BA-LP filtering unit 350, a second switching unit 360, an LTP unit 370, a transform encoding unit 380, and a high-frequency band encoding unit 390.

The FA-LP filtering unit 320 includes an FA-LP analysis unit 321, an LPC coefficient quantization unit 322, and a first FA-LP filter 323.

The BA-LP filtering unit 350 includes a BA-LP analysis unit 351 and a first BA-LP filter 352.

The LTP unit 370 includes a second band splitting unit 371, a pitch analysis unit 372, a first long-term predictor (LTP) 373, a first LTP application unit 374, a second LTP 375, a second LTP application unit 376, a third LTP 377, a third LTP application unit 378, and a first band synthesis unit 379.

The transform encoding unit 380 may include a transform unit 381, a quantization unit 382, an inverse quantization unit 383, and an inverse transform unit 384.

The adaptive encoding apparatus may further include a third band splitting unit 391, a buffering unit 392, a second band synthesis unit 393, a second FA-LP filter 397, a second BA-LP filter 395, and a multiplexing unit 396.

The first band splitting unit 310 splits an input signal IN into a low-frequency band signal and a high-frequency band signal. The input signal IN may be a PCM signal obtained after an analog speech or audio signal is modulated into a digital signal. The low-frequency band signal may correspond to a frequency lower than an arbitrary threshold value, and the high-frequency band signal may correspond to a frequency higher than the arbitrary threshold value.

The FA-LP filtering unit 320 can perform forward adaptive linear prediction on the low-frequency band signal and thus filter the low-frequency band signal. Forward adaptive linear prediction is performed based on past speech samples. When forward adaptive linear prediction is performed, LPC coefficients must be transmitted to a decoding end as additional information.

The FA-LP analysis unit 321 performs a linear prediction analysis of the low-frequency band signal based on past samples and extracts LPC coefficients. The LPC coefficient quantization unit 322 quantizes the LPC coefficients extracted by the FA-LP analysis unit 321. The first FA-LP filter 323 filters the low-frequency band signal using the quantized LPC coefficients.

The signal analysis unit 330 analyses the low-frequency band signal received from the first band splitting unit 310, determines whether to perform backward adaptive linear prediction and multi-band long-term prediction on the low-frequency band signal, and outputs mode information MODE.

Specifically, the signal analysis unit 330 may determine whether to perform backward adaptive linear prediction on the low-band frequency band signal according to the degree to which the low-frequency band signal is stationary. For example, if the low-frequency band signal is highly stationary, the signal analysis unit 330 may determine to perform backward adaptive linear prediction on the low-frequency band signal. If not, the signal analysis unit 330 may determine not to perform backward adaptive linear prediction on the low-frequency band signal.

In addition, the signal analysis unit 330 may determine whether to perform backward adaptive linear prediction according to a backward adaptive linear prediction gain value of the low-frequency band signal. For example, if the low-frequency band signal has a high backward adaptive linear prediction gain value, the signal analysis unit 330 may determine to perform backward adaptive linear prediction on the low-frequency band signal.

The signal analysis unit 330 may determine whether to perform multi-band long-term prediction on the low-frequency band signal according to periodicity of the low-frequency band signal for each frequency band. For example, the signal analysis unit 330 may analyse periodicity of the low-frequency band signal for each frequency band and determine to perform long-term prediction on the low-frequency band signal if the low-frequency band signal has strong periodic characteristics.

The first switching unit 340 switches the low-frequency band signal filtered by the FA-LP filtering unit 320 to the BA-LP filtering unit 350 based on the mode information MODE received from the signal analysis unit 330.

The BA-LP filtering unit 350 performs backward adaptive linear prediction on the low-frequency band signal filtered by the FA-LP filtering unit 320 and thus filters the low-frequency band signal. Here, backward adaptive linear prediction is performed based on reconfigured past speech samples, and there is no need to transmit additional information to the decoding end.

The BA-LP analysis unit 351 performs a backward adaptive linear prediction analysis using the low-frequency band signal filtered by the second FA-LP filter 397. Specifically, the BA-LP analysis unit 351 performs the backward adaptive linear prediction analysis using high-order filter coefficients which were extracted from the low-frequency band signal filtered by the second FA-LP filter 397.

The first BA-LP filter 352 filters the low-frequency band signal filtered by the first FA-LP filter 323 based on the result output from the BA-LP analysis unit 351.

For example, if the low-frequency band signal is highly stationary, the signal analysis unit 330 may determine to perform backward adaptive linear prediction on the low-frequency band signal and provide the mode information MODE to the first switching unit 340. Here, backward adaptive linear prediction is performed on the low-frequency band signal filtered by the FA-LP filtering unit 320 to filter the low-frequency band signal again, thereby reducing the number of bits allocated to an encoding operation.

The second switching unit 360 switches the low-frequency band signal filtered by the FA-LP filtering unit 320 or the low-frequency band signal filtered by the BA-LP filtering unit 350 to the LTP unit 370 based on the mode information MODE received from the signal analysis unit 330.

Specifically, when the signal analysis unit 330 determines to perform long-term prediction on the low-frequency band signal, the second switching unit 360 may provide the low-frequency band signal filtered by the first BA-LP filter 352 to the LTP unit 370. In addition, when the signal analysis unit 330 determines not to perform long-term prediction on the low-frequency band signal, the second switching unit 360 may provide the low-frequency band signal filtered by the first BA-LP filter 352 not to the LTP unit 370, but to the transform encoding unit 380.

The LTP unit 370 performs multi-band long-term prediction on the low-frequency band signal filtered by the FA-LP filtering unit 320 or the low-frequency band signal filtered by the BA-LP filtering unit 350 and outputs an excitation signal. Specifically, the LTP unit 370 splits the low-frequency band signal filtered by the FA-LP filtering unit 320 or the low-frequency band signal filtered by the BA-LP filtering unit 350 into a plurality of bands and performs long-term prediction on each band. Then, the LTP unit 370 synthesizes the results of long-term prediction and outputs an excitation signal.

The second band splitting unit 371 splits the low-frequency band signal filtered by the first FA-LP filter 323 or the low-frequency band signal filtered by the first BA-LP filter 352 into a plurality of bands. For example, the second band splitting unit 371 may split the low-frequency band signal filtered by the first FA-LP filter 323 or the low-frequency band signal filtered by the first BA-LP filter 352 into three bands and output a low band signal LB, a middle band signal MB and a high band signal HB.

As described above, a pitch prediction gain can be increased using a different pitch gain for each frequency band. Generally, a long-term prediction gain value of a low-frequency band is high, and that of a high-frequency band is low. Therefore, encoding efficiency can be enhanced by applying a different gain value to each frequency band. It may be understood by those of ordinary skill in the art to which the present embodiment belongs that the second band splitting unit 371 can split the low-frequency band signal filtered by the first FA-LP filter 323 or the low-frequency band signal filtered by the first BA-LP filter 352 into any predetermined number of bands other than three bands.

The pitch analysis unit 372 analyses the pitch of the low band signal LB received from the second band slitting unit 371.

The first LTP 373 performs long-term prediction on the low band signal LB received from the second band splitting unit 371 using the analysis result of the pitch analysis unit 372 and provides a first result $E_L$ to the first LTP application unit 374. In addition, the first LTP 373 outputs a pitch lag PL and a first gain value $G_L$.

The first LTP application unit 374 selectively applies the first result $E_L$ to the low band signal LB received from the second band splitting unit 371 based on the mode information MODE output from the signal analysis unit 330. Specifically, when the signal analysis unit 330 determines to perform long-term prediction on the low band signal LB, the first LTP application unit 374 applies the first result $E_L$ to the low band signal LB, that is, subtracts the first result $E_L$ from the low band signal LB.

The second LTP 375 performs long-term prediction on the middle band signal MB received from the second band splitting unit 371 and provides a second result $E_M$ to the second LTP application unit 376. In addition, the second LTP 375 outputs a first delta pitch lag $DPL_M$ and a second gain value $G_M$. The first delta pitch lag $DPL_M$ may be the difference between a pitch lag extracted after long-term prediction is performed on the middle band signal MB and the pitch lag PL output from the first LTP 373. Therefore, the number of bits allocated to the encoding operation can be reduced.

The second LTP application unit 376 selectively applies the second result $E_M$ to the middle band signal MB received from the second band splitting unit 371 based on the mode information MODE output from the signal analysis unit 330. Specifically, when the signal analysis unit 330 determines to perform long-term prediction on the middle band signal MB, the second LTP application unit 376 applies the second result $E_M$ to the middle band signal MB, that is, subtracts the second result $E_M$ from the middle band signal MB.

The third LTP 377 performs long-term prediction on the high band signal HB received from the second band splitting unit 371 and provides a third result $E_H$ to the third LTP application unit 378. In addition, the third LTP 377 outputs a second delta pitch lag $DPL_H$ and a third gain value $G_H$. The second delta pitch lag $DPL_H$ may be the difference between a pitch lag extracted after long-term prediction is performed on the high band signal HB and the pitch lag PL output from the first LTP 373. Also, the second delta pitch lag $DPL_H$ may be the difference between the pitch lag extracted after long-term prediction is performed on the high band signal HB and the first delta pitch lag $DPL_M$ output from the second LTP 375. Therefore, the number of bits allocated to the encoding operation can be reduced.

The third LTP application unit 378 selectively applies the third result $E_H$ to the high band signal HB received from the second band splitting unit 371 based on the mode information MODE output from the signal analysis unit 330. Specifically, when the signal analysis unit 330 determines to perform long-term prediction on the high band signal HB, the third LTP application unit 378 applies the third result $E_H$ to the high band signal HB, that is, subtracts the third result $E_H$ from the high band signal HB.

The first band synthesis unit 379 synthesizes signals output from the first through third LTP application units 374 through 378 and outputs an excitation signal.

The transform encoding unit 380 transforms the low-frequency band signal filtered by the first FA-LP filter 323, the low-frequency band signal filtered by the first BA-LP filter 352, or the excitation signal output from the LTP unit 370 into a signal in a frequency domain and quantizes the signal using perceptual importance.

The transform unit 381 transforms the low-frequency band signal filtered by the first FA-LP filter 323, the low-frequency band signal filtered by the first BA-LP filter 352, or the excitation signal output from the LTP unit 370 from a time domain to a frequency domain. The quantization unit 382 quantizes a signal output from the transform unit 381 and outputs a quantization index QI. The inverse quantization unit 383 inversely quantizes the signal quantized by the quantization unit 382. The inverse transform unit 384 inversely transforms the signal inversely quantized by the inverse quantization unit 383 into a signal in the time domain.

The third band splitting unit 391 splits the signal output from the inverse transform unit 384 into bands corresponding to the bands output from the second band splitting unit 371.

The buffering unit 392 buffers signals output from the third band splitting unit 391 and provides buffered signals B1 through B3 to the first through third LTP 373 through 377, respectively. In this case, the buffered signals B1 through B3 provided to the first through third LTP 373 through 377 are used to perform long-term prediction.

The second band synthesis unit 393 synthesizes the first through third results $E_L$, $E_M$ and $E_H$ output from the first through third LTP 373 through 377.

An addition unit 394 adds a signal output the second band synthesis unit 393 to the signal output from the inverse transform unit 384.

The third switching unit 395 switches a signal obtained as a result of the addition of the addition unit 394 to the second BA-LP filter 396 or the second FA-LP filter 397 based on the mode information MODE received from the signal analysis unit 330.

The second BA-LP filter 396 performs backward adaptive linear prediction on the signal output from the addition unit 394 and thus filters the signal.

The second FA-LP filter 397 performs forward adaptive linear prediction on the signal output from the addition unit 394 or the signal filtered by the second BA-LP filter 396 and thus filters the signal. In this case, the BA-LP analysis unit 351 may perform backward adaptive linear prediction based on the signal filtered by the second FA-LP filter 397. That is, the BA-LP analysis unit 351 performs an encoding operation using high-order coefficients which were obtained from past signals.

The high-frequency band encoding unit 390 encodes the high-frequency band signal output from the first band splitting unit 310 using the low-frequency band signal encoded by the transform encoding unit 380 and the long-term prediction result of the LTP unit 370. For example, the high-frequency band encoding unit 390 may fold the low-frequency band signal in the high-frequency band signal and thus encode the high-frequency band signal.

The multiplexing unit 398 multiplexes the LPC coefficients quantized by the LPC coefficient quantization unit 322, the mode information MODE for backward adaptive linear prediction and long-term prediction determined by the signal analysis unit 330, the pitch lag PL and the first gain value $G_L$ output from the first LTP 373, the first delta pitch lag $DPL_M$ and the second gain value $G_M$ output from the second LTP 375, the second delta pitch lag $DPL_H$ and the third gain value $G_H$ output from the third LTP 377, the quantization index QI output from the quantization unit 382, and an encoding result HC output from the high-frequency band encoding unit 390. Consequently, the multiplexing unit 398 generates and outputs a bit-stream.

Figure 4:
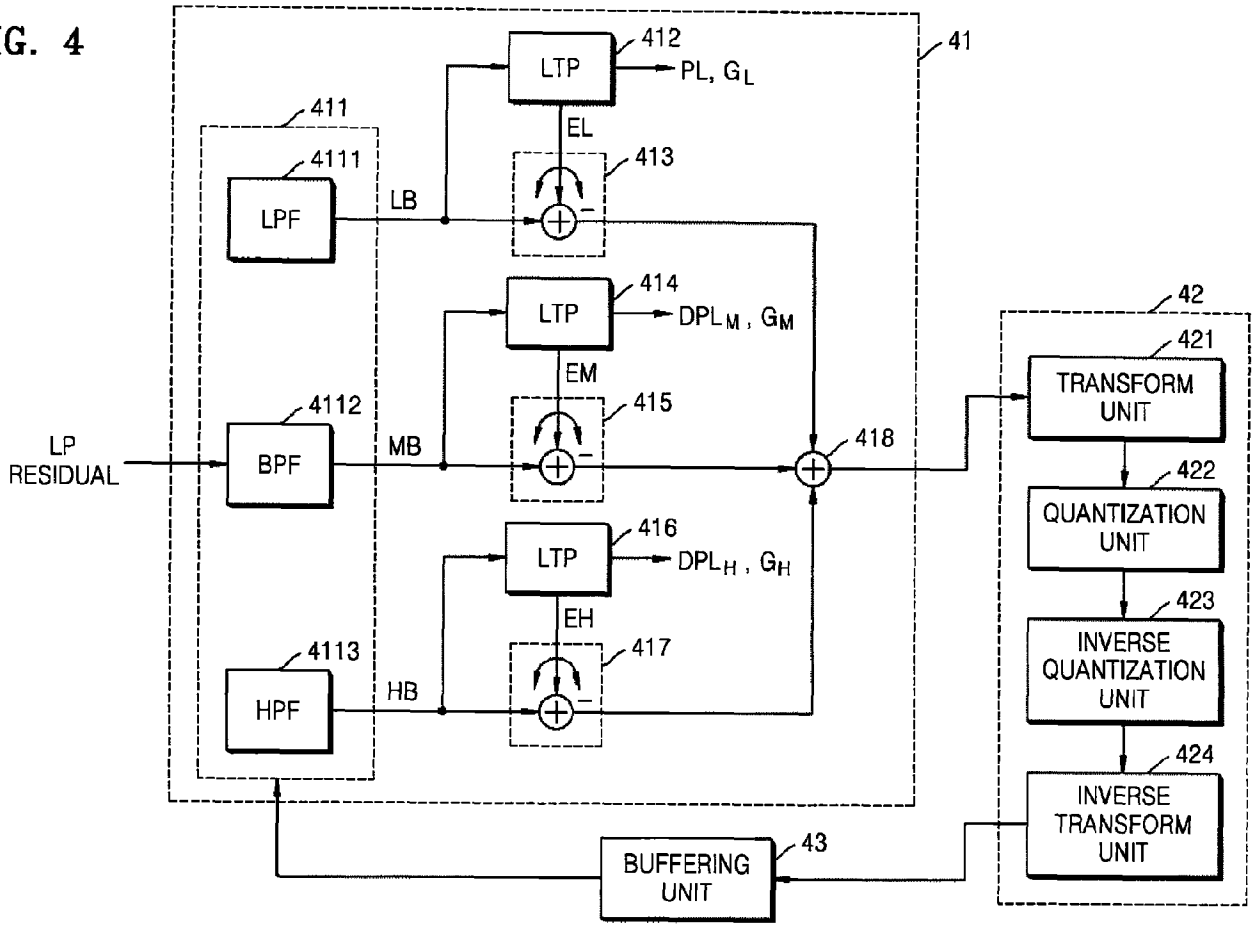
FIG. 4 is a block diagram of an LTP unit, a transform encoding unit, and a buffering unit included in the adaptive encoding apparatus illustrated in FIG. 1 according to an embodiment.

FIG. 4 is a block diagram of an LTP unit 41, a transform encoding unit 42, and a buffering unit 43 included in the adaptive encoding apparatus illustrated in FIG. 1, according to an embodiment.

Referring to FIG. 4, the LTP unit 41 includes a band splitting unit 411, a first LTP 412, a first LTP application unit 413, a second LTP 414, a second LTP application unit 415, a third LTP 416, a third LTP application 417, and a band synthesis unit 418. The transform encoding unit 42 includes a transform unit 421, a quantization unit 422, an inverse quantization unit 423, and an inverse transform unit 424.

Using a plurality of band-pass filters, the band splitting unit 411 splits a linear prediction (LP) residual received from the FA-LP filtering unit 12 or the BA-LP filtering unit 15 of FIG. 1 into a plurality of bands in a time domain.

For example, the band splitting unit 411 may split the LP residual into three bands. Specifically, the band splitting unit 411 includes a low-pass filter (LPF) 4111, a band-pass filter (BPF) 4112 and a high-pass filter (HPF) 4113 and splits the LP residual received from the FA-LP filtering unit 12 or the BA-LP filtering unit 15 into a low band signal LB, a middle band signal MB, and a high band signal HB. It may be understood by those of ordinary skill in the art to which the present embodiment belongs that the band splitting unit 411 can split the LP residual into any predetermined number of bands other than three bands.

The first LTP 412 analyses the pitch of the low band signal LB, performs long-term prediction on the low band signal LB using the analysis result, and provides a first result $E_L$ to the first LTP application unit 413. In addition, the first LTP 412 outputs a pitch lag PL and a first gain value $G_L$. The LTP 370 illustrated in FIG. 3 further includes the pitch analysis unit 372. However, this is merely an embodiment, and it should be understood by those of ordinary skill in the art to which the present embodiment belongs that each of the first through third LTPs 412 through 416 can analyse the pitch of a signal output from the band splitting unit 411 and perform long-term prediction on the signal.

The first LTP application unit 413 selectively applies the first result $E_L$ to the low band signal LB received from the LPF 4111 based on the mode information MODE output from the signal analysis unit 13 of FIG. 1. Specifically, when the signal analysis unit 13 determines to perform long-term prediction on the low band signal LB, the first LTP application unit 413 applies the first result $E_L$ to the low band signal LB, that is, subtracts the first result $E_L$ from the low band signal LB.

The second LTP 414 analyses the pitch of the middle band signal MB, performs long-term prediction on the middle band signal MB using the analysis result, and provides a second result $E_M$ to the second LTP application unit 415. In addition, the second LTP 414 outputs a first delta pitch lag $DPL_M$ and a second gain value $G_M$. The first delta pitch lag $DPL_M$ may be the difference between a pitch lag extracted after long-term prediction is performed on the middle band signal MB and the pitch lag PL output from the first LTP 412. Therefore, the number of bits allocated to the encoding operation can be reduced.

The second LTP application unit 415 selectively applies the second result $E_M$ to the middle band signal MB received from the BPF 4112 based on the mode information MODE output from the signal analysis unit 13 of FIG. 1. Specifically, when the signal analysis unit 13 determines to perform long-term prediction on the middle band signal MB, the second LTP application unit 415 applies the second result $E_M$ to the middle band signal MB, that is, subtracts the second result $E_M$ from the middle band signal MB.

The third LTP 416 analyses the pitch of the high band signal HB, performs long-term prediction on the high band signal HB using the analysis result, and provides a third result $E_H$ to the third LTP application unit 417. In addition, the third LTP 416 outputs a second delta pitch lag $DPL_H$ and a third gain value $G_H$. The second delta pitch lag $DPL_H$ may be the difference between a pitch lag extracted after long-term prediction is performed on the high band signal HB and the pitch lag PL output from the first LTP 412. Also, the second delta pitch lag $DPL_H$ may be the difference between the pitch lag extracted after long-term prediction is performed on the high band signal HB and the first delta pitch lag $DPL_M$ output from the second LTP 414. Therefore, the number of bits allocated to the encoding operation can be reduced.

The third LTP application unit 417 selectively applies the third result $E_H$ to the high band signal HB received from the HPF 4113 based on the mode information MODE output from the signal analysis unit 13 of FIG. 1. Specifically, when the signal analysis unit 13 determines to perform long-term prediction on the high band signal HB, the third LTP application unit 417 applies the third result $E_H$ to the high band signal HB, that is, subtracts the third result $E_H$ from the high band signal HB.

The band synthesis unit 418 synthesizes signals output from the first through third LTP application units 413 through 417 and outputs an excitation signal. In this case, since the band splitting unit 411 splits the LP residual into a plurality of bands using the LPF 4111, the BPF 4112 and the HPF 4113, the band synthesis unit 418 may simply add the signals output from the first through third LTP application units 413 through 417 without performing an additional synthesis process.

The transform encoding unit 42 transforms the low-frequency band signal filtered by the FA-LP filtering unit 12 of FIG. 1, the low-frequency band signal filtered by the BA-LP filtering unit 15 of FIG. 1, or the excitation signal output from the LTP unit 41 into a signal in a frequency domain and quantizes the signal using perceptual importance.

The transform unit 421 transforms the low-frequency band signal filtered by the FA-LP filtering unit 12 of FIG. 1, the low-frequency band signal filtered by the BA-LP filtering unit 15 of FIG. 1, or the excitation signal output from the LTP unit 41 from the time domain to the frequency domain. The quantization unit 422 quantizes a signal output from the transform unit 421 and outputs a quantization index. The inverse quantization unit 423 inversely quantizes the signal quantized by the quantization unit 422. The inverse transform unit 424 inversely transforms the signal inversely quantized by the inverse quantization unit 423 into a signal in the time domain.

The buffering unit 43 buffers the signal output from the inverse transform unit 424 and provides the buffered signal to the band splitting unit 411. In this case, the buffered signal provided to the band splitting unit 411 is used to perform long-term prediction. Specifically, the buffering unit 43 may buffer the signal output from the inverse transform unit 424 without splitting the signal into a plurality of bands. This is because the LPF 4111, the BPF 4112 and the HPF 4113 of the band splitting unit 411 can split the buffered signal into a plurality of corresponding bands.

Figure 5:
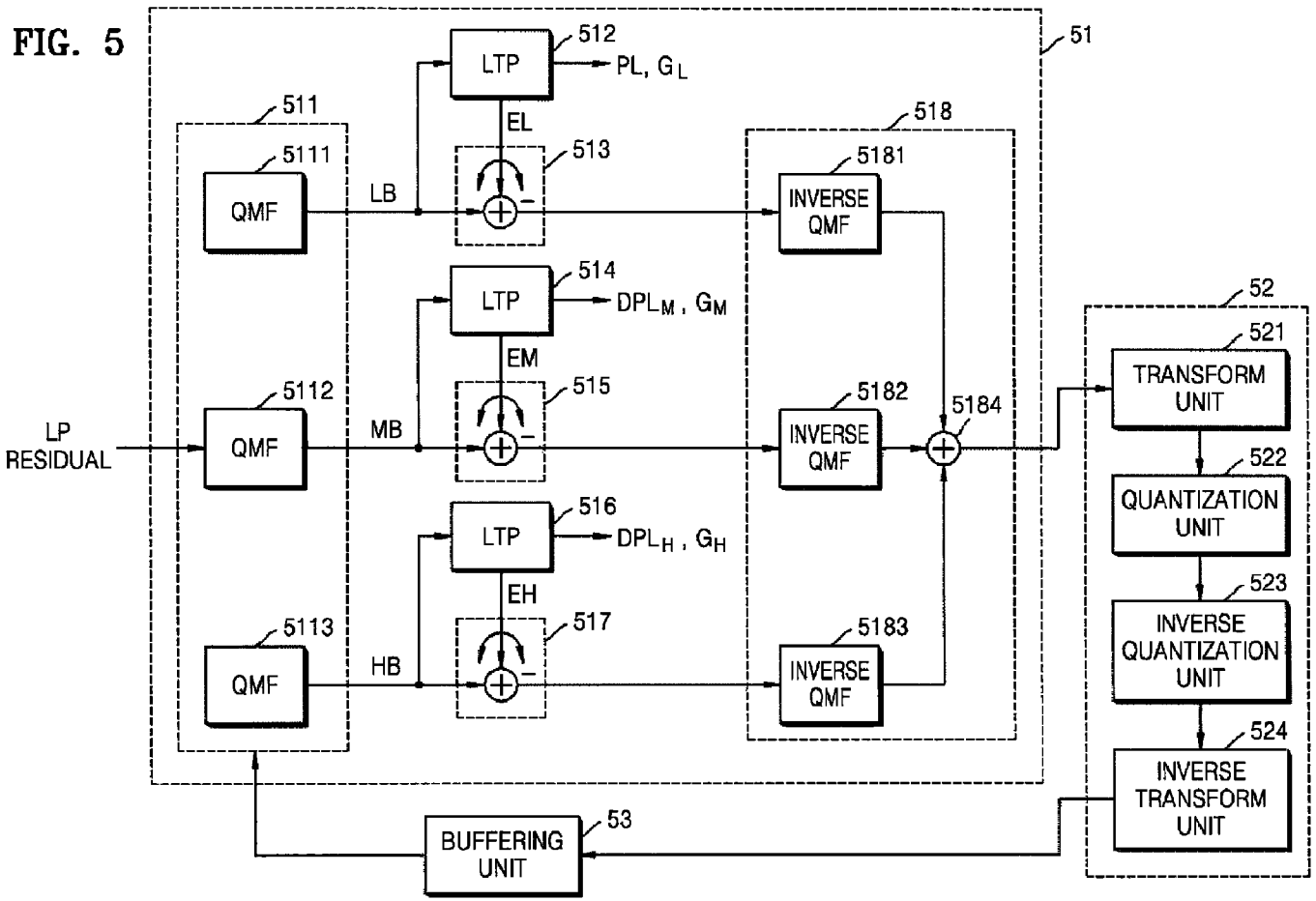
FIG. 5 is a block diagram of an LTP unit, a transform encoding unit, and a buffering unit included in the adaptive encoding apparatus illustrated in FIG. 1 according to another embodiment.

FIG. 5 is a block diagram of an LTP unit 51, a transform encoding unit 52, and a buffering unit 53 included in the adaptive encoding apparatus illustrated in FIG. 1 according to another embodiment.

Referring to FIG. 5, the LTP unit 51 includes a band splitting unit 511, a first LTP 512, a first LTP application unit 513, a second LTP 514, a second LTP application unit 515, a third LTP 516, a third LTP application 517, and a band synthesis unit 518. The transform encoding unit 52 includes a transform unit 521, a quantization unit 522, an inverse quantization unit 523, and an inverse transform unit 524.

Using a plurality of quadrature mirror filters (QMFs), the band splitting unit 511 splits an LP residual received from the FA-LP filtering unit 12 or the BA-LP filtering unit 15 of FIG. 1 into a plurality of bands. Since the band splitting unit 511 uses the QMFs, it can remove phase distortion when restoring a full-band excitation signal from a filtered signal.

For example, the band splitting unit 511 may split the LP residual into three bands. Specifically, the band splitting unit 511 includes a first QMF 5111, a second QMF 5112 and a third QMF 5113 and splits the LP residual received from the FA-LP filtering unit 12 or the BA-LP filtering unit 15 into a low band signal LB, a middle band signal MB, and a high band signal HB. It may be understood by those of ordinary skill in the art to which the present embodiment belongs that the band splitting unit 511 can split the LP residual into any predetermined number of bands other than three bands.

The first LTP 512 analyses the pitch of the low band signal LB, performs long-term prediction on the low band signal LB using the analysis result, and provides a first result $E_L$ to the first LTP application unit 513. In addition, the first LTP 512 outputs a pitch lag PL and a first gain value $G_L$. The LTP 370 illustrated in FIG. 3 further includes the pitch analysis unit 372. However, this is merely an embodiment, and it should be understood by those of ordinary skill in the art to which the present embodiment belongs that each of the first through third LTPs 512 through 516 can analyse the pitch of a signal output from the band splitting unit 511 and perform long-term prediction on the signal.

The first LTP application unit 513 selectively applies the first result $E_L$ to the low band signal LB received from the first QMF 5111 based on the mode information MODE output from the signal analysis unit 13 of FIG. 1. Specifically, when the signal analysis unit 13 determines to perform long-term prediction on the low band signal LB, the first LTP application unit 513 applies the first result $E_L$ to the low band signal LB, that is, subtracts the first result $E_L$ from the low band signal LB.

The second LTP 514 analyses the pitch of the middle band signal MB, performs long-term prediction on the middle band signal MB using the analysis result, and provides a second result $E_M$ to the second LTP application unit 515. In addition, the second LTP 514 outputs a first delta pitch lag $DPL_M$ and a second gain value $G_M$. The first delta pitch lag $DPL_M$ may be the difference between a pitch lag extracted after long-term prediction is performed on the middle band signal MB and the pitch lag PL output from the first LTP 512. Therefore, the number of bits allocated to the encoding operation can be reduced.

The second LTP application unit 515 selectively applies the second result $E_M$ to the middle band signal MB received from the second QMF 5112 based on the mode information MODE output from the signal analysis unit 13 of FIG. 1. Specifically, when the signal analysis unit 13 determines to perform long-term prediction on the middle band signal MB, the second LTP application unit 515 applies the second result $E_M$ to the middle band signal MB, that is, subtracts the second result $E_M$ from the middle band signal MB.

The third LTP 516 analyses the pitch of the high band signal HB, performs long-term prediction on the high band signal HB using the analysis result, and provides a third result $E_H$ to the third LTP application unit 517. In addition, the third LTP 516 outputs a second delta pitch lag $DPL_H$ and a third gain value $G_H$. The second delta pitch lag $DPL_H$ may be the difference between a pitch lag extracted after long-term prediction is performed on the high band signal HB and the pitch lag PL output from the first LTP 512. Also, the second delta pitch lag $DPL_H$ may be the difference between the pitch lag extracted after long-term prediction is performed on the high band signal HB and the first delta pitch lag $DPL_M$ output from the second LTP 514. Therefore, the number of bits allocated to the encoding operation can be reduced.

The third LTP application unit 517 selectively applies the third result $E_H$ to the high band signal HB received from the third QMF 5113 based on the mode information MODE output from the signal analysis unit 13 of FIG. 1. Specifically, when the signal analysis unit 13 determines to perform long-term prediction on the high band signal HB, the third LTP application unit 517 applies the third result $E_H$ to the high band signal HB, that is, subtracts the third result $E_H$ from the high band signal HB.

The band synthesis unit 518 synthesizes signals output from the first through third LTP application units 513 through 517 and outputs an excitation signal. Specifically, the band synthesis unit 518 includes first through third inverse QMFs 5181 through 5183 and an addition unit 5184. The first through third inverse QMFs 5181 through 5183 receive the signals output from the first through third LTP application units 513 through 517, respectively, and perform inverse QMF filtering on the received signals. The addition unit 5184 synthesizes the signals filtered by the first through third inverse QMFs 5181 through 5183.

The transform encoding unit 52 transforms the low-frequency band signal filtered by the FA-LP filtering unit 12 of FIG. 1, the low-frequency band signal filtered by the BA-LP filtering unit 15 of FIG. 1, or the excitation signal output from the LTP unit 51 into a signal in the frequency domain and quantizes the signal using perceptual importance.

The transform unit 521 transforms the low-frequency band signal filtered by the FA-LP filtering unit 12 of FIG. 1, the low-frequency band signal filtered by the BA-LP filtering unit 15 of FIG. 1, or the excitation signal output from the LTP unit 51 from the time domain to the frequency domain. The quantization unit 522 quantizes a signal output from the transform unit 521 and outputs a quantization index. The inverse quantization unit 523 inversely quantizes the signal quantized by the quantization unit 522. The inverse transform unit 524 inversely transforms the signal inversely quantized by the inverse quantization unit 523 into a signal in the time domain.

The buffering unit 53 buffers the signal output from the inverse transform unit 524 and provides the buffered signal to the band splitting unit 511. In this case, the buffered signal provided to the band splitting unit 511 is used to perform long-term prediction. Specifically, the buffering unit 53 may buffer the signal output from the inverse transform unit 524 without splitting the signal into a plurality of bands. This is because the first through third QMFs 5111 through 5113 of the band splitting unit 511 can split the buffered signal into a plurality of corresponding bands.

Figure 6:
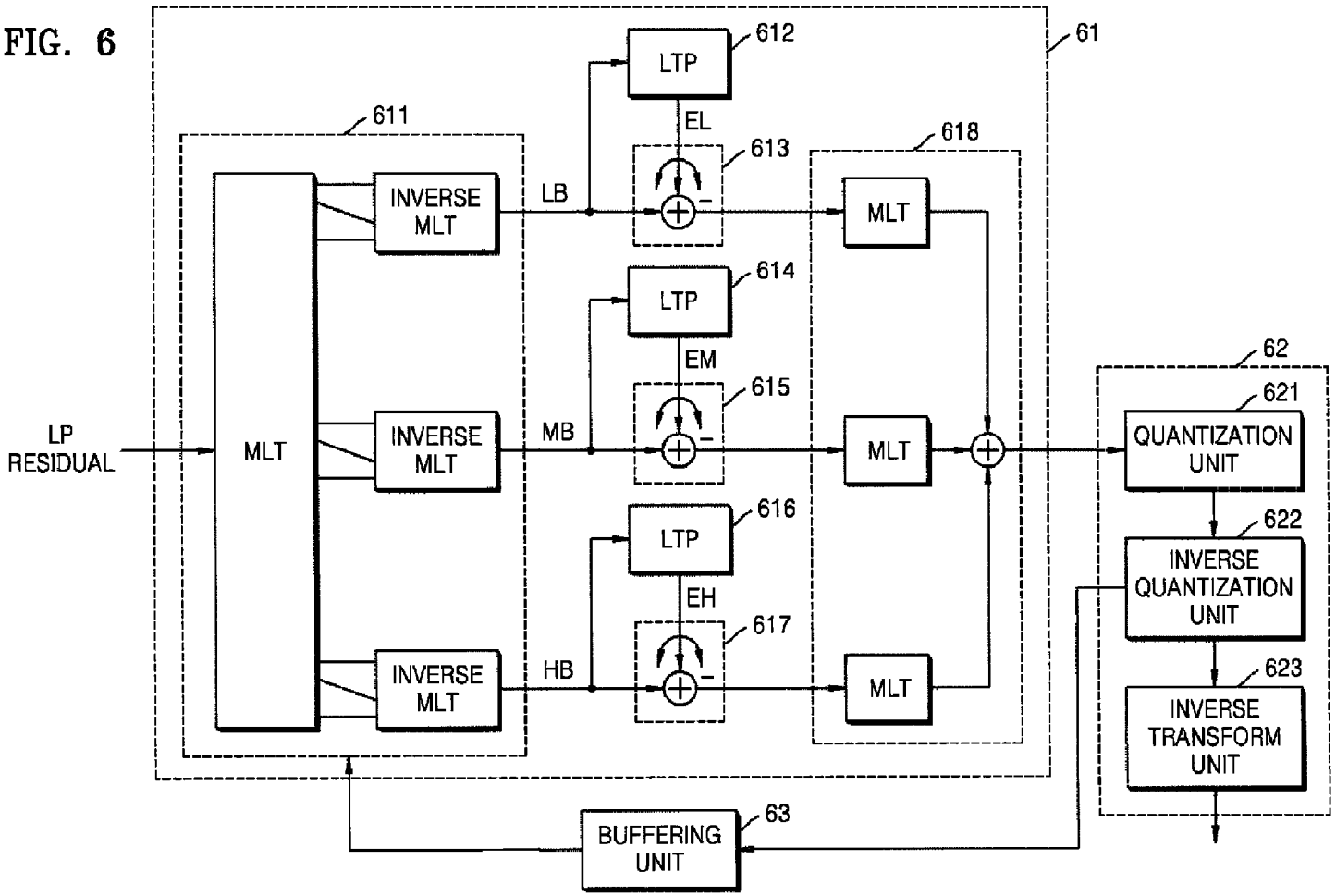
FIG. 6 is a block diagram of an LTP unit, an encoding unit, and a buffering unit included in the adaptive encoding apparatus illustrated in FIG. 1 according to another embodiment.

FIG. 6 is a block diagram of an LTP unit 61, an encoding unit 62, and a buffering unit 63 included in the adaptive encoding apparatus illustrated in FIG. 1 according to another embodiment.

Referring to FIG. 6, the LTP unit 61 includes a band splitting unit 611, a first LTP 612, a first LTP application unit 613, a second LTP 614, a second LTP application unit 615, a third LTP 616, a third LTP application 617, and a band synthesis unit 618. The encoding unit 62 includes a quantization unit 621, an inverse quantization unit 622, and an inverse transform unit 623.

Using frequency-varying modulated lapped transforms (FV-MLTs), the band splitting unit 611 splits an LP residual received from the FA-LP filtering unit 12 or the BA-LP filtering unit 15 of FIG. 1 into a plurality of bands. Specifically, the band splitting unit 611 converts the LP residual into a plurality of frequency signals using the FV-MLTs and outputs the frequency signals. Then, the band splitting unit 611 performs an inverse FV-MLT on each of the frequency signals and thus produces a plurality of bands required to perform long-term prediction. Using the FV-MLTs, the band splitting unit 611 can split the LP residual in a non-uniform manner. In addition, since the band synthesis unit 618 transforms an excitation signal into a signal in the frequency domain while synthesizing the excitation signal, there is no need for the encoding unit 62 to additionally include a transform unit.

For example, the band splitting unit 611 may split the LP residual into a low band signal LB, a middle band signal MB, and a high band signal HB. It should be understood by those of ordinary skill in the art to which the present embodiment belongs that the band splitting unit 611 can split the LP residual into any predetermined number of bands other than three bands.

The first LTP 612 analyses the pitch of the low band signal LB, performs long-term prediction on the low band signal LB using the analysis result, and provides a first result $E_L$ to the first LTP application unit 613. In addition, the first LTP 612 outputs a pitch lag PL and a first gain value $G_L$. The LTP 370 of the embodiment of in FIG. 3 further includes the pitch analysis unit 372. However, this is merely an embodiment, and it should be understood by those of ordinary skill in the art to which the present embodiment belongs that each of the first through third LTPs 612 through 616 can analyse the pitch of a signal output from the band splitting unit 611 and perform long-term prediction on the signal.

The first LTP application unit 613 selectively applies the first result $E_L$ to the low band signal LB based on the mode information MODE output from the signal analysis unit 13 of FIG. 1. Specifically, when the signal analysis unit 13 determines to perform long-term prediction on the low band signal LB, the first LTP application unit 613 applies the first result $E_L$ to the low band signal LB, that is, subtracts the first result $E_L$ from the low band signal LB.

The second LTP 614 analyses the pitch of the middle band signal MB, performs long-term prediction on the middle band signal MB using the analysis result, and provides a second result $E_M$ to the second LTP application unit 615. In addition, the second LTP 614 outputs a first delta pitch lag $DPL_M$ and a second gain value $G_M$. The first delta pitch lag $DPL_M$ may be the difference between a pitch lag extracted after long-term prediction is performed on the middle band signal MB and the pitch lag PL output from the first LTP 612. Therefore, the number of bits allocated to the encoding operation can be reduced.

The second LTP application unit 615 selectively applies the second result $E_M$ to the middle band signal MB based on the mode information MODE output from the signal analysis unit 13 of FIG. 1. Specifically, when the signal analysis unit 13 determines to perform long-term prediction on the middle band signal MB, the second LTP application unit 615 applies the second result $E_M$ to the middle band signal MB, that is, subtracts the second result $E_M$ from the middle band signal MB.

The third LTP 616 analyses the pitch of the high band signal HB, performs long-term prediction on the high band signal HB using the analysis result, and provides a third result $E_H$ to the third LTP application unit 617. In addition, the third LTP 616 outputs a second delta pitch lag $DPL_H$ and a third gain value $G_H$. The second delta pitch lag $DPL_H$ may be the difference between a pitch lag extracted after long-term prediction is performed on the high band signal HB and the pitch lag PL output from the first LTP 612. Also, the second delta pitch lag $DPL_H$ may be the difference between the pitch lag extracted after long-term prediction is performed on the high band signal HB and the first delta pitch lag $DPL_M$ output from the second LTP 614. Therefore, the number of bits allocated to the encoding operation can be reduced.

The third LTP application unit 617 selectively applies the third result $E_H$ to the high band signal HB based on the mode information MODE output from the signal analysis unit 13 of FIG. 1. Specifically, when the signal analysis unit 13 determines to perform long-term prediction on the high band signal HB, the third LTP application unit 617 applies the third result $E_H$ to the high band signal HB, that is, subtracts the third result $E_H$ from the high band signal HB.

The band synthesis unit 618 transforms signals output from the first through third LTP application units 613 through 617 using the respective MLTs, adds the signals, and outputs an excitation signal.

The encoding unit 62 quantizes the low-frequency band signal filtered by the FA-LP filtering unit 12 of FIG. 1, the low-frequency band signal filtered by the BA-LP filtering unit 15 of FIG. 1, or the excitation signal output from the LTP unit 61.

The quantization unit 621 quantizes the excitation signal output from the band synthesis unit 618 and outputs a quantization index. The inverse quantization unit 622 inversely quantizes the signal quantized by the quantization unit 621. The inverse transform unit 623 performs an inverse MLT on the signal inversely quantized by the inverse quantization unit 622 and outputs the result of the inverse MLT to the addition unit 394 of FIG. 3.

The buffering unit 63 buffers the signal output from the inverse quantization unit 622 and provides the buffered signal to the band splitting unit 611. In this case, the buffered signal provided to the band splitting unit 611 is used to perform long-term prediction. Specifically, the buffering unit 63 may buffer the inversely quantized signal without splitting it into a plurality of bands. This is because the FV-MLTs of the band splitting unit 611 can split the buffered signal into a plurality of corresponding bands.

Figure 7:
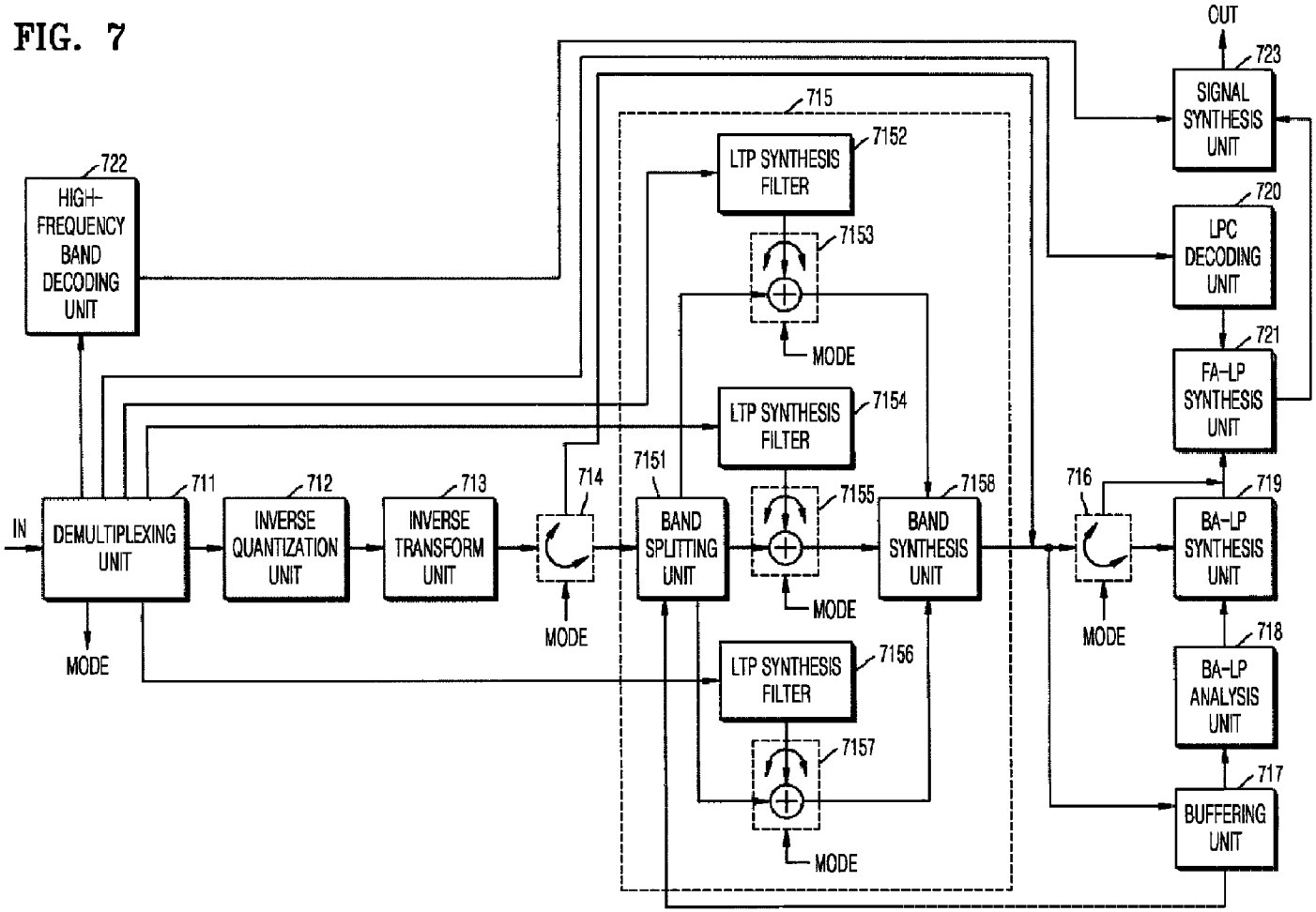
FIG. 7 is a block diagram of an adaptive decoding apparatus according to an embodiment.

FIG. 7 is a block diagram of an adaptive decoding apparatus according to an embodiment.

Referring to FIG. 7, the adaptive decoding apparatus according to this embodiment includes a demultiplexing unit 711, an inverse quantization unit 712, an inverse transform unit 713, a first switching unit 714, a LTP synthesis unit 715, a second switching unit 716, a buffering unit 717, a BA-LP analysis unit 718, a BA-LP synthesis filter 719, an LPC coefficient decoding unit 720, an FA-LP synthesis filter 721, a high-frequency band decoding unit 722, and a signal synthesis unit 723.

The demultiplexing unit 711 analyses a bitstream received from an encoder and outputs encoding information of a high-frequency band signal, LPC coefficients, a quantization index, mode information MODE indicating whether the encoder has performed backward adaptive linear prediction and long-term prediction, a pitch lag and a gain value of a low band signal, a delta pitch lag and a gain value of a middle band signal, and a delta pitch lag and a gain value of a high band signal.

The inverse quantization unit 712 inversely quantizes a quantization index output from the demultiplexing unit 711.

The inverse transform unit 713 inversely transforms the signal, which was inversely quantized by the inverse quantization unit 712, into a signal in the time domain.

The first switching unit 714 switches the signal output from the inverse transform unit 713 based on the mode information MODE output from the demultiplexing unit 711. Specifically, the mode information MODE may indicate whether the encoder has performed long-term prediction. When determining that the encoder has performed long-term prediction, the first switching unit 714 switches the signal output from the inverse transform unit 713 to the LTP synthesis unit 715.

The LTP synthesis unit 715 synthesizes the long-term prediction result of the encoder with the signal output from the inverse transform unit 713. The LTP synthesis unit 715 includes a band splitting unit 7151, a first LTP synthesis filter 7152, a first LTP application unit 7153, a second LTP synthesis filter 7154, a second LTP application unit 7155, a third LTP synthesis filter 7156, a third LTP application unit 7157, and a band synthesis unit 7158.

The band spotting unit 7151 splits the signal output from the inverse transform unit 713 into a plurality of bands. For example, the band splitting unit 7151 may split the signal output from the inverse transform unit 713 into three bands and output a low band signal, a middle band signal and a high band signal. It should be understood by those of ordinary skill in the art to which the present embodiment belongs that the band splitting unit 7151 can split the signal output from the inverse transform unit 713 into any predetermined number of bands other than three bands.

The first LTP synthesis filter 7152 outputs a long-term prediction result of the encoder using the pitch lag and the gain value of the low band signal which was output from the demultiplexing unit 711.

The first LTP application unit 7153 selectively applies the long-term prediction result, which was output from the first LTP synthesis filter 7152, based on the mode information MODE output from the demultiplexing unit 711. In this case, the mode information MODE may indicate whether the encoder has performed long-term prediction.

The second LTP synthesis filter 7154 outputs a long-term prediction result of the encoder using the delta pitch lag and the gain value of the middle band signal which was output from the demultiplexing unit 711.

The second LTP application unit 7155 selectively applies the long-term prediction result, which was output from the second LTP synthesis filter 7154, based on the mode information MODE output from the demultiplexing unit 711. In this case, the mode information MODE may indicate whether the encoder has performed long-term prediction.

The third LTP synthesis filter 7156 outputs a long-term prediction result of the encoder using the delta pitch lag and the gain value of the high band signal which was output from the demultiplexing unit 711.

The third LTP application unit 7157 selectively applies the long-term prediction result, which was output from the third LTP synthesis filter 7156, based on the mode information MODE output from the demultiplexing unit 711. In this case, the mode information MODE may indicate whether the encoder has performed long-term prediction.

The band synthesis unit 7158 synthesizes signals output from the first through third LTP application units 7153 through 7157.

The band splitting unit 7151 may split a signal output from the inverse transform unit 713 into the bands using a plurality of band pass filters, and the band synthesis unit 7158 may simply add the bands and thus synthesize them into a single signal. Alternatively, the band splitting unit 7151 and the band synthesis unit 7158 may split the signal output from the inverse transform unit 713 into the bands using a plurality of QMFs or FV-MLTs and synthesize the bands.

The second switching unit 716 switches the signal output from the inverse transform unit 713 or a signal output from the LTP synthesis unit 715 based on the mode information MODE which was output from the demultiplexing unit 711. In this case, the mode information MODE may indicate whether the encoder has performed backward adaptive linear prediction. When determining that the encoder has performed backward adaptive linear prediction, the second switching unit 716 switches the signal output from the inverse transform unit 713 or the signal output from the LTP synthesis unit 715 to the BA-LP synthesis filter 719.

The buffering unit 717 buffers the signal output from the inverse transform unit 713 or a signal output from the band synthesis unit 7158 and provides the buffered signal to the band splitting unit 7151. In this case, the buffered signal is used for LTP synthesis by the first through third LTP synthesis filters 7152 through 7156. However, it may be understood by those of ordinary skill in the art to which the present embodiment belongs that the signal buffered by the buffering unit 717 can be directly input to the first through third LTP synthesis filters 7152 through 7156 instead of the band splitting unit 7151.

The BA-LP analysis unit 718 performs backward adaptive linear prediction analysis using the signal buffered by the buffering unit 717.

The BA-LP synthesis filter 719 synthesizes the result of backward adaptive linear prediction with the signal output from the inverse transform unit 713 or the signal output from the band synthesis unit 7158.

The LPC decoding unit 720 decodes the LPC coefficients output from the demultiplexing unit 711.

The FA-LP synthesis filter 721 synthesizes the result of forward adaptive linear prediction with the signal output from the inverse transform unit 713, the signal output from the band synthesis unit 7158, or the signal output from the BA-LP synthesis filter 719 using the LPC coefficients decoded by the LPC decoding unit 720.

The high-frequency band decoding unit 722 decodes the high-frequency band signal using the signal output from the inverse transform unit 713 and signals output from the LTP synthesis unit 715 and based on the encoding information of the high-frequency band signal output from the demultiplexing unit 711. For example, the high-frequency band decoding unit 722 may fold the low-frequency band signal in the high-frequency band signal and thus decode the high-frequency band signal. In addition, the high-frequency band decoding unit 722 may adjust the envelope of the folded high-frequency band signal using an energy value of each band and the LPC coefficients included in the encoding information of the high-frequency band signal.

The signal synthesis unit 723 synthesizes the low-frequency band signal output from the FA-LP synthesis filter 721 with the high-frequency band signal decoded by the high-frequency band decoding unit 722 and outputs the synthesis result.

Figure 8:
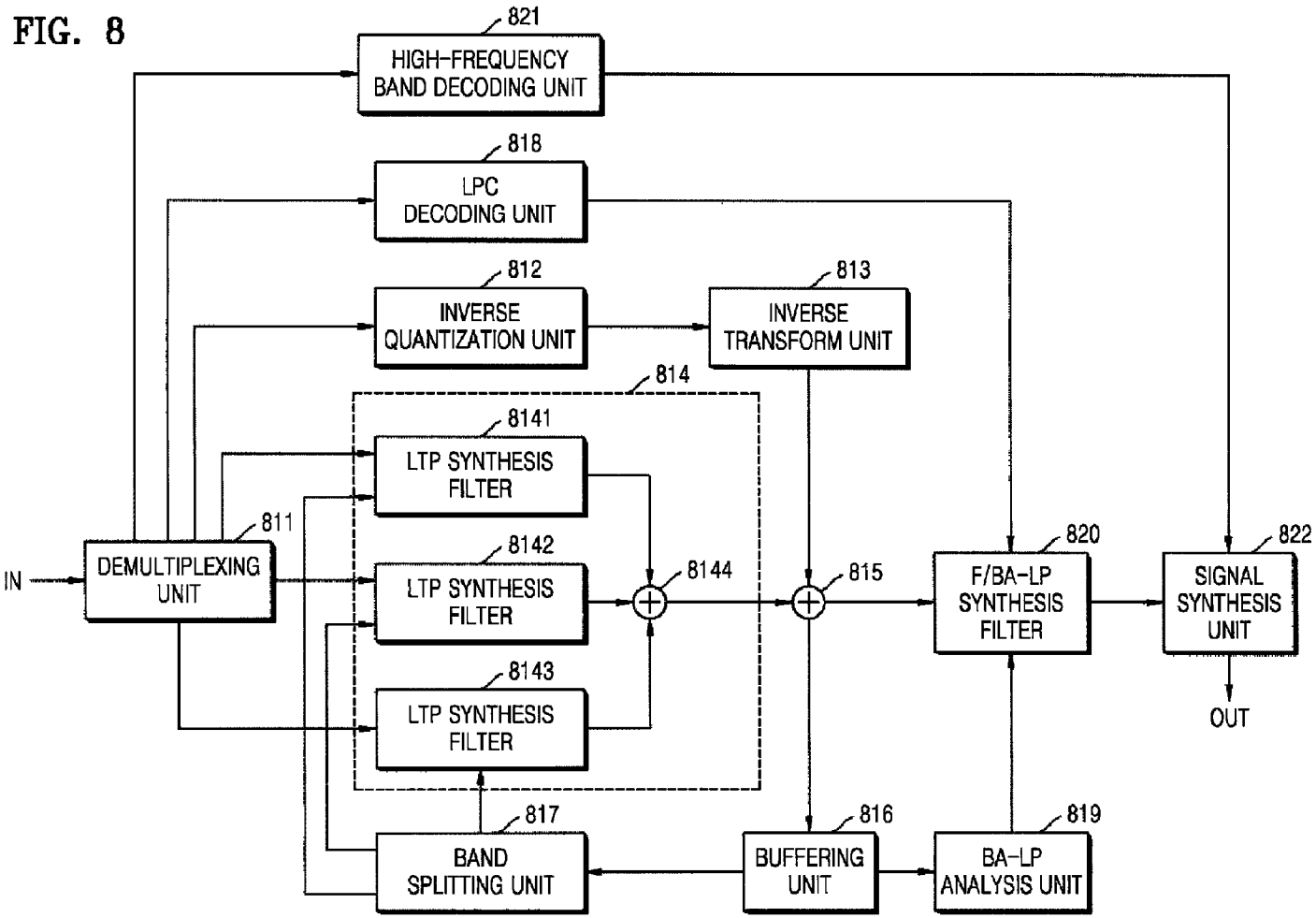
FIG. 8 is a block diagram of an adaptive decoding apparatus according to another embodiment.

FIG. 8 is a block diagram of an adaptive decoding apparatus according to another embodiment.

Referring to FIG. 8, the adaptive decoding apparatus includes a demultiplexing unit 811, an inverse quantization unit 812, an inverse transform unit 813, a LTP synthesis unit 814, a first addition unit 815, a buffering unit 816, a band splitting unit 817, an LPC coefficient decoding unit 818, a BA-LP analysis unit 819, a forward/backward adaptive (F/BA)-LP synthesis filter 820, a high-frequency band decoding unit 821, and a signal synthesis unit 822.

The demultiplexing unit 811 analyses a bitstream received from an encoder and outputs encoding information of a high-frequency band signal, LPC coefficients, information indicating whether the encoder has performed backward adaptive linear prediction and long-term prediction, a quantization index, a pitch lag and a gain value of a low band signal, a delta pitch lag and a gain value of a middle band signal, and a delta pitch lag and a gain value of a high band signal.

The inverse quantization unit 812 inversely quantizes a quantization index output from the demultiplexing unit 811.

The inverse transform unit 813 inversely transforms the signal, which was inversely quantized by the inverse quantization unit 812, into a signal in the time domain.

The LTP synthesis unit 814 includes first through third LTP synthesis filters 8141 through 8143 and a second addition unit 8144.

The first LTP synthesis filter 8141 outputs a long-term prediction result of the encoder using the pitch lag and the gain value of the low band signal which was output from the demultiplexing unit 811.

The second LTP synthesis filter 8142 outputs a long-term prediction result of the encoder using the delta pitch lag and the gain value of the middle band signal which was output from the demultiplexing unit 811.

The third LTP synthesis filter 8143 outputs a long-term prediction result of the encoder using the delta pitch lag and the gain value of the high band signal which was output from the demultiplexing unit 811.

The second addition unit 8144 adds and thus synthesizes signals output from the first through third LTP synthesis filters 8141 through 8143.

The first addition unit 815 adds and thus synthesizes the signal output from the inverse transform unit 813 and a signal output from the second addition 8144.

The buffering unit 816 buffers a signal output from the first addition unit 815 and provides the buffered signal to the band splitting unit 817. In this case, the buffered signal is used for long-term prediction by the first through third LTP synthesis filters 8141 through 8143.

The band splitting unit 817 splits the buffered signal into a plurality of bands and outputs the bands to the first through third LTP synthesis filters 8141 through 8143, respectively. Here, the band splitting unit 817 may split the buffered signal into the bands using a plurality of band pass filters. Alternatively, the band splitting unit 817 may split the buffered signal into the bands using a plurality of QMFs or FV-MLTs. For example, the band splitting unit 817 may split the signal buffered by the buffering unit 816 into a low band signal, a middle band signal and a high band signal.

The LPC decoding unit 818 decodes the LPC coefficients output from the demultiplexing unit 811.

The BA-LP analysis unit 819 performs backward adaptive linear prediction analysis using the signal buffered by the buffering unit 816.

The F/BA-LP synthesis filter 820 selectively synthesizes the result of backward adaptive linear prediction analysis of the BA-LP analysis unit 819 with the signal output from the first addition unit 815. Alternatively, the F/BA-LP synthesis filter 820 synthesizes the signal output from the first addition unit 815 or a signal synthesized with the result of backward adaptive linear prediction using the LPC coefficients decoded by the LPC coefficient decoding unit 818.

The high-frequency band decoding unit 821 decodes the high-frequency band signal using the signals output from the first through third LTP synthesis filters 8141 through 8143 or the signal output from the first addition unit 815. For example, the high-frequency band decoding unit 821 may fold the low-frequency band signal in the high-frequency band signal and thus decode the high-frequency band signal. In addition, the high-frequency band decoding unit 821 may adjust the envelope of the folded high-frequency band signal using an energy value of each band and the LPC coefficients included in the encoding information of the high-frequency band signal.

The signal synthesis unit 822 synthesizes the low-frequency band signal output from the F/BA-LP synthesis filter 820 with the high-frequency band signal decoded by the high-frequency band decoding unit 821 and outputs the synthesis result.

Figure 9:
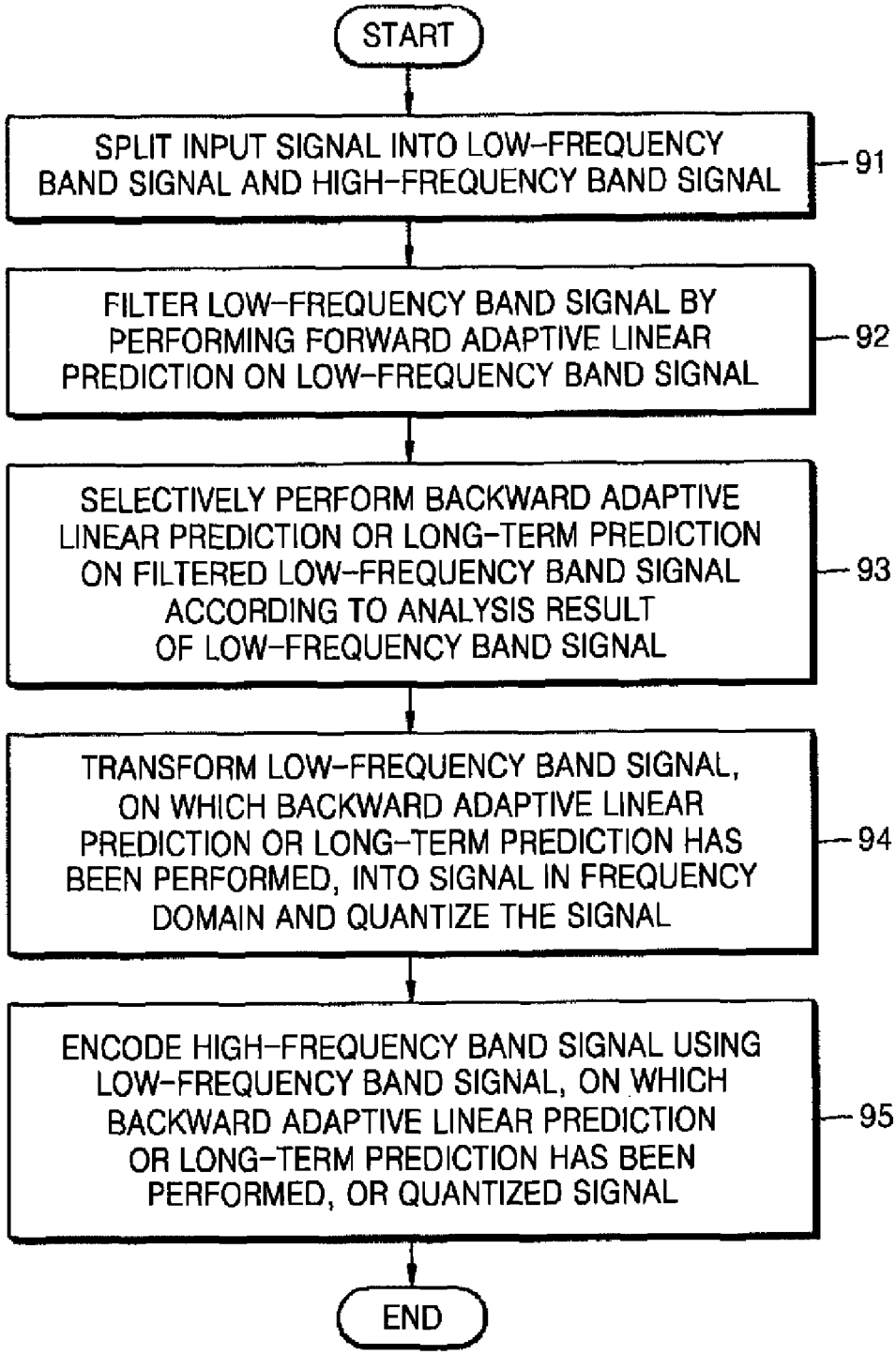
FIG. 9 is a flowchart schematically illustrating an adaptive encoding method according to an embodiment.

FIG. 9 is a flowchart schematically illustrating an adaptive encoding method according to an embodiment of the present invention.

Referring to FIG. 9, the adaptive encoding method includes operations processed in a time series manner by the adaptive encoding apparatus illustrated in FIG. 1. Accordingly, technical features described above in relation to the adaptive encoding apparatus of FIG. 1 are also applied to the adaptive encoding method according to the present embodiment although a detailed description of the technical features may be omitted below.

In operation 91, the band splitting unit 11 splits an input signal into a low-frequency band signal and a high-frequency band signal.

In operation 92, the FA-LP filtering unit 12 performs forward adaptive linear prediction on the low-frequency band signal and thus filters the low-frequency band signal.

In operation 93, the BA-LP filtering unit 15 performs backward adaptive linear prediction filtering on the low-frequency band signal filtered by the FA-LP filtering unit 12 or the LTP unit 17 performs long-term prediction on the low-frequency band signal filtered by the FA-LP filtering unit 12 according to the result of analysing the low-frequency band using the signal analysis unit 13. It can be understood by those of ordinary skill in the art to which the present embodiment belongs that both of the BA-LP filtering unit 15 and the LTP unit 17 may or may not operate according to the analysis result of the signal analysis unit 13.

In operation 94, the transform encoding unit 18 transforms an output of the BA-LP filtering unit 15 or an output of the LTP unit 17 into a signal in the frequency domain and quantizes the signal.

In operation 95, the high-frequency band encoding unit 19 encodes the high-frequency band signal using the output of the BA-LP filtering unit 15, the output of the LTP unit 17, or the signal quantized by the transform encoding unit 18.

Figure 10:
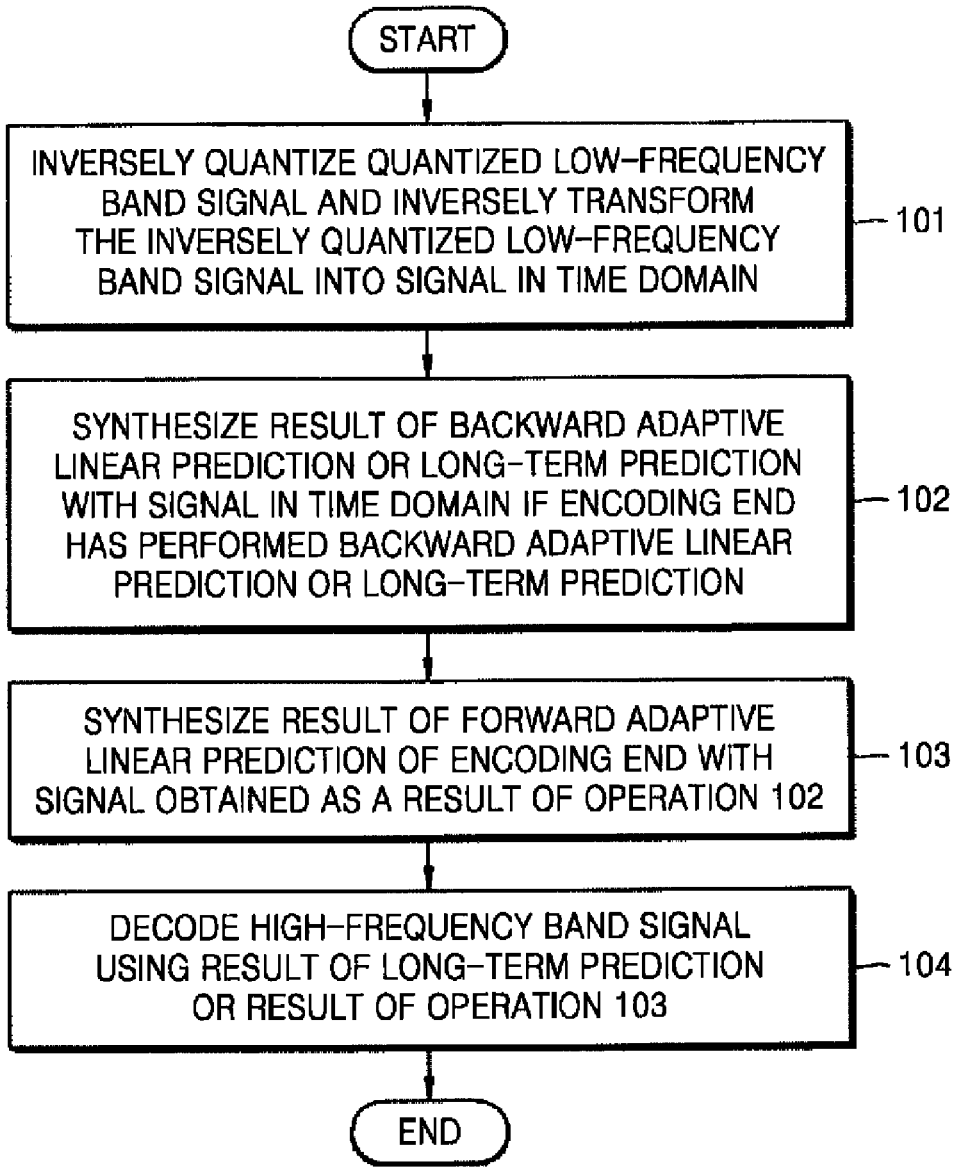
FIG. 10 is a flowchart illustrating an adaptive decoding method according to an embodiment.

FIG. 10 is a flowchart illustrating an adaptive decoding method according to an embodiment.

Referring to FIG. 10, the adaptive decoding method includes operations processed in a time series manner by the adaptive decoding apparatus illustrated in FIG. 7. Accordingly, technical features described above in relation to the adaptive decoding apparatus of FIG. 7 are also applied to the adaptive decoding method according to the present embodiment although a detailed description of the technical features may be omitted below.

In operation 101, the inverse quantization unit 712 inversely quantizes a quantized low-frequency band signal, and the inverse transform unit 713 inversely transforms the inversely quantized low-frequency band signal into a signal in the time domain.

In operation 102, if an encoding end has performed backward adaptive linear prediction or long-term prediction, the BA-LP synthesis filter 719 synthesizes the result of backward adaptive linear prediction with the signal output from the inverse transform unit 713 or the LTP synthesis unit 715 synthesizes the result of long-term prediction with the signal output from the inverse transform unit 713. It can be understood by those of ordinary skill in the art to which the present embodiment belongs that both of the BA-LP synthesis filter 719 and the LTP synthesis unit 715 may or may not operate according to mode information indicating whether the encoding end has performed backward adaptive linear prediction and long-term prediction.

In operation 103, the FA-LP synthesis filter 721 synthesizes the result of forward adaptive linear prediction of the encoding end with the synthesis result of the BA-LP synthesis filter 719 or a signal output from the LTP synthesis unit 715.

In operation 104, the high-frequency band decoding unit 722 decodes a high-frequency band signal using the result of long-term prediction or the synthesis result of the FA-LP synthesis filter 721.

According to embodiments herein, an input signal is split into a low-frequency band signal and a high-frequency band signal. Then, forward adaptive linear prediction is performed on the low-frequency band signal, thereby filtering the low-frequency band signal. Based on the result of analysing the low-frequency band signal, backward adaptive linear prediction or long-term prediction is selectively performed on the filtered low-frequency band signal. After backward adaptive linear prediction or long-term prediction is performed, the low-frequency band signal is transformed into a signal in the frequency domain, and the signal is quantized. Finally, the high-frequency band signal is encoded using the low-frequency band signal, on which backward adaptive linear prediction or long-term prediction has been performed, or the quantized signal. Since embodiments herein adaptively perform backward adaptive linear prediction according to characteristics of the input signal, compression efficiency for both speech and music signals can be enhanced.

According to embodiments herein, long-term prediction is adaptively performed for each frequency band according to the characteristics of the input signal. Therefore, a robust compression method can be provided for various audio contents at a low bit rate. In addition, the embodiments herein can efficiently compress music and voice by simultaneously reflecting auditory characteristics and a speech production model in a signal compression unit.

Therefore, embodiments herein can be used when a storage or display apparatus of an acoustic information device, such as a mobile phone, a computer, a wireless device or an electronics imaging device, compresses and restores speech and music signals at a high compression rate and a high sound quality.

The embodiments herein are not limited to only those described above and may be embodied in many different forms as understood by those of ordinary skill in the art without departing from the spirit and scope of the present invention.

The embodiments herein can also be implemented as computer-readable code on a computer-readable recording medium. The computer-readable recording medium is any data storage device that can store data which can be thereafter read by a computer system. Examples of the computer-readable recording medium include read-only memory (ROM), random-access memory (RAM), CD-ROMs, magnetic tapes, floppy disks, optical data storage devices, and carrier waves (such as data transmission through the Internet).

The computer-readable recording medium can also be distributed over network-coupled computer systems so that the computer-readable code is stored and executed in a distributed fashion.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An adaptive encoding method comprising:

splitting an input signal into a low-frequency band signal and a high-frequency band signal;

performing forward adaptive linear prediction on the low-frequency band signal and thus filtering the low-frequency band signal;

selectively performing, performed by at least one processor, backward adaptive linear prediction or long-term prediction on the filtered low-frequency band signal according to an analysis result of the low-frequency band signal;

transforming the low-frequency band signal, on which backward adaptive linear prediction or long-term prediction has been performed, into a signal in a frequency domain and quantizing the signal; and encoding the high-frequency band signal using the low-frequency band signal, on which backward adaptive linear prediction or long-term prediction has been performed, or the quantized signal.

2. The method of claim 1, wherein the selectively performing of the backward adaptive linear prediction or long-term prediction comprises:

performing backward adaptive linear prediction on the filtered low-frequency band signal if a value indicating a degree to which the low-frequency band signal is stationary is greater than a predetermined first threshold value or a backward adaptive linear prediction gain value is greater than a predetermined second threshold value according to the analysis result of the low-frequency band signal; and performing long-term prediction on the filtered low-frequency band signal if a value indicating periodicity of the low-frequency band signal for each frequency band is greater than a predetermined third threshold value according to the analysis result of the low-frequency band signal.

3. The method of claim 2, wherein the performing of the long-term prediction comprises:

splitting the filtered low-frequency band signal into a plurality of bands using a plurality of band pass filters;

performing long-term prediction on each band signal according to the analysis result of the low-frequency band signal; and adding the signals on which long-term prediction has been performed.

4. The method of claim 2, wherein the performing of the long-term prediction comprises:

splitting the filtered low-frequency band signal into a plurality of bands using a plurality of quadrature mirror filters (QMFs);

performing long-term prediction on each band signal according to the analysis result of the low-frequency band signal; and performing inverse quadrature mirror filtering on each of the signals, on which long-term prediction has been performed, and adding the signals on which inverse quadrature mirror filtering has been performed.

5. The method of claim 2, wherein the performing of the long-term prediction comprises:

splitting the filtered low-frequency band signal into a plurality of bands using a plurality of frequency-vary modulated lapped transforms (FV-MLTs);

performing long-term prediction on each band signal according to the analysis result of the low-frequency band signal; and performing an inverse MLT on each of the signals, on which long-term prediction has been performed, and adding the signals on which the inverse MLT has been performed.

6. The method of claim 1, further comprising:

inversely quantizing the quantized signal and inversely transforming the inversely quantized signal into a signal in a time domain; and buffering the signal in the time domain, wherein long-term prediction is performed using the buffered signal in the selectively performing of the backward adaptive linear prediction or long-term prediction.

7. A non-transitory computer-readable recording medium having recorded thereon a program to execute an adaptive encoding method, the method comprising:

splitting an input signal into a low-frequency band signal and a high-frequency band signal;

performing forward adaptive linear prediction on the low-frequency band signal and thus filtering the low-frequency band signal;

selectively performing backward adaptive linear prediction or long-term prediction on the filtered low-frequency band signal according to an analysis result of the low-frequency band signal;

transforming the low-frequency band signal, on which backward adaptive linear prediction or long-term prediction has been performed, into a signal in a frequency domain and quantizing the signal; and encoding the high-frequency band signal using the low-frequency band signal, on which backward adaptive linear prediction or long-term prediction has been performed, or the quantized signal.

8. The non-transitory computer-readable recording medium of claim 7, wherein the selectively performing of the backward adaptive linear prediction or long-term prediction comprises:

performing backward adaptive linear prediction on the filtered low-frequency band signal if a value indicating a degree to which the low-frequency band signal is stationary is greater than a predetermined first threshold value or a backward adaptive linear prediction gain value is greater than a predetermined second threshold value according to the analysis result of the low-frequency band signal; and performing long-term prediction on the filtered low-frequency band signal if a value indicating periodicity of the low-frequency band signal for each frequency band is greater than a predetermined third threshold value according to the analysis result of the low-frequency band signal.

9. The non-transitory computer-readable recording medium of claim 8, wherein the selectively performing of the backward adaptive linear prediction or long-term prediction comprises:

performing backward adaptive linear prediction on the filtered low-frequency band signal if a value indicating a degree to which the low-frequency band signal is stationary is greater than a predetermined first threshold value or a backward adaptive linear prediction gain value is greater than a predetermined second threshold value according to the analysis result of the low-frequency band signal; and performing long-term prediction on the filtered low-frequency band signal if a value indicating periodicity of the low-frequency band signal for each frequency band is greater than a predetermined third threshold value according to the analysis result of the low-frequency band signal.

10. The non-transitory computer-readable recording medium of claim 8, wherein the performing of the long-term prediction comprises:

splitting the filtered low-frequency band signal into a plurality of bands using a plurality of band pass filters;

performing long-term prediction on each band signal according to the analysis result of the low-frequency band signal; and adding the signals on which long-term prediction has been performed.

11. The non-transitory computer-readable recording medium of claim 8, wherein the performing of the long-term prediction comprises:

splitting the filtered low-frequency band signal into a plurality of bands using a plurality of frequency-vary modulated lapped transforms (FV-MLTs);

performing long-term prediction on each band signal according to the analysis result of the low-frequency band signal; and performing an inverse MLT on each of the signals, on which long-term prediction has been performed, and adding the signals on which the inverse MLT has been performed.

12. The non-transitory computer-readable recording medium of claim 7, further comprising:

inversely quantizing the quantized signal and inversely transforming the inversely quantized signal into a signal in a time domain; and buffering the signal in the time domain, wherein long-term prediction is performed using the buffered signal in the selectively performing of the backward adaptive linear prediction or long-term prediction.

13. An adaptive decoding method comprising:

inversely quantizing a quantized low-frequency band signal and inversely transforming the inversely quantized low-frequency band signal into a signal in a time domain;

synthesizing, performed by at least one processor, a result of backward adaptive linear prediction or long-term prediction with the signal in the time domain if an encoding end has performed backward adaptive linear prediction or long-term prediction;

synthesizing a result of forward adaptive linear prediction of the encoding end with a signal obtained after the synthesizing of the result of backward adaptive linear prediction or long-term prediction with the signal in the time domain; and decoding a high-frequency band signal using the result of long-term prediction or the result of synthesizing the result of forward adaptive linear prediction of the encoding end with the signal.

14. The method of claim 13, further comprising:

buffering the signal in the time domain, wherein the result of backward adaptive linear prediction or long-term prediction is synthesized with the signal in the time domain using the buffered signal in the synthesizing of the result of backward adaptive linear prediction or long-term prediction with the signal in the time domain.

15. The method of claim 14, wherein the synthesizing of the result of backward adaptive linear prediction or long-term prediction with the signal in the time domain comprises:

splitting the signal in the time domain into a plurality of bands using a plurality of FV-MLTs if the encoding end has performed long-term prediction;

synthesizing the result of long-term prediction of the encoding end with each band signal; and performing an inverse MLT on each signal obtained after the result of long-term prediction was synthesized with each band signal and adding the signals on which the inverse MLT has been performed.

16. The method of claim 13, wherein the synthesizing of the result of backward adaptive linear prediction or long-term prediction with the signal in the time domain comprises:

splitting the signal in the time domain into a plurality of bands using a plurality of band pass filters if the encoding end has performed long-term prediction;

synthesizing the result of long-term prediction of the encoding end with each band signal; and adding signals obtained after the result of long-term prediction was synthesized with each band signal.

17. The method of claim 13, wherein the synthesizing of the result of backward adaptive linear prediction or long-term prediction with the signal in the time domain comprises:

splitting the signal in the time domain into a plurality of bands using a plurality of QMFs if the encoding end has performed long-term prediction;

synthesizing the result of long-term prediction of the encoding end with each band signal; and performing inverse quadrature mirror filtering on each signal obtained after the result of long-term prediction was synthesized with each band signal and adding the signals on which inverse quadrature mirror filtering has been performed.

18. A non-transitory computer-readable recording medium having recorded thereon a program to execute adaptive decoding method, the method comprising:

inversely quantizing a quantized low-frequency band signal and inversely transforming the inversely quantized low-frequency band signal into a signal in a time domain;

synthesizing a result of backward adaptive linear prediction or long-term prediction with the signal in the time domain if an encoding end has performed backward adaptive linear prediction or long-term prediction;

synthesizing a result of forward adaptive linear prediction of the encoding end with a signal obtained after the synthesizing of the result of backward adaptive linear prediction or long-term prediction with the signal in the time domain; and decoding a high-frequency band signal using the result of long-term prediction or the result of synthesizing the result of forward adaptive linear prediction of the encoding end with the signal.

19. The non-transitory computer-readable recording medium of claim 18, further comprising:

buffering the signal in the time domain, wherein the result of backward adaptive linear prediction or long-term prediction is synthesized with the signal in the time domain using the buffered signal in the synthesizing of the result of backward adaptive linear prediction or long-term prediction with the signal in the time domain.

20. The non-transitory computer-readable recording medium of claim 18, wherein the synthesizing of the result of backward adaptive linear prediction or long-term prediction with the signal in the time domain comprises:

splitting the signal in the time domain into a plurality of bands using a plurality of band pass filters if the encoding end has performed long-term prediction;

synthesizing the result of long-term prediction of the encoding end with each band signal; and adding signals obtained after the result of long-term prediction was synthesized with each band signal.

21. The non-transitory computer-readable recording medium of claim 18, wherein the synthesizing of the result of backward adaptive linear prediction or long-term prediction with the signal in the time domain comprises:

splitting the signal in the time domain into a plurality of bands using a plurality of QMFs if the encoding end has performed long-term prediction;

synthesizing the result of long-term prediction of the encoding end with each band signal; and performing inverse quadrature mirror filtering on each signal obtained after the result of long-term prediction was synthesized with each band signal and adding the signals on which inverse quadrature mirror filtering has been performed.

22. The non-transitory computer-readable recording medium of claim 18, wherein the synthesizing of the result of backward adaptive linear prediction or long-term prediction with the signal in the time domain comprises:

splitting the signal in the time domain into a plurality of bands using a plurality of FV-MLTs if the encoding end has performed long-term prediction;

synthesizing the result of long-term prediction of the encoding end with each band signal; and performing an inverse MLT on each signal obtained after the result of long-term prediction was synthesized with each band signal and adding the signals on which the inverse MLT has been performed.

23. An adaptive encoding apparatus comprising:

a band splitting unit to split an input signal into a low-frequency band signal and a high-frequency band signal;

a forward adaptive linear prediction (FA-LP) filtering unit to perform forward adaptive linear prediction on the low-frequency band signal and thus filtering the low-frequency band signal;

a selective performance unit, implemented by at least one processor, to selectively perform backward adaptive linear prediction or long-term prediction on the filtered low-frequency band signal according to an analysis result of the low-frequency band signal;

a transform encoding unit to transform the low-frequency band signal, on which backward adaptive linear prediction or long-term prediction has been performed, into a signal in a frequency domain and quantizing the signal; and a high-frequency band encoding unit to encode the high-frequency band signal using the low-frequency band signal, on which backward adaptive linear prediction or long-term prediction has been performed, or the quantized signal.

24. The apparatus of claim 23, wherein the selective performance unit comprises:

a signal analysis unit to analyze the low-frequency band signal;

a backward adaptive linear prediction (BA-LP) filtering unit to perform backward adaptive linear prediction on the filtered low-frequency band signal if a value indicating a degree to which the low-frequency band signal is stationary is greater than a predetermined first threshold value or a backward adaptive linear prediction gain value is greater than a predetermined second threshold value according to the analysis result of the low-frequency band signal; and a long-term prediction (LTP) unit to perform long-term prediction on the filtered low-frequency band signal if a value indicating periodicity of the low-frequency band signal for each frequency band is greater than a predetermined third threshold value according to the analysis result of the low-frequency band signal.

25. The apparatus of claim 24, wherein the LTP unit comprises:

a band splitting unit to split the filtered low-frequency band signal into a plurality of bands using a plurality of band pass filters;

a long-term predictor to perform long-term prediction on each band signal according to the analysis result of the low-frequency band signal; and an adding unit to add the signals on which long-term prediction has been performed.

26. The apparatus of claim 24, wherein the LTP unit comprises;

a band splitting unit to split the filtered low-frequency band signal into a plurality of bands using a plurality of QMFs;

a long-term predictor to perform long-term prediction on each band signal according to the analysis result of the low-frequency band signal; and an addition unit to perform inverse quadrature mirror filtering on each of the signals, on which long-term prediction has been performed, and to add the signals on which inverse quadrature mirror filtering has been performed.

27. The apparatus of claim 24, wherein the LTP unit comprises:

a band splitting unit to split the filtered low-frequency band signal into a plurality of bands using a plurality of FV-MLTs;

a long-term predictor to perform long-term prediction on each band signal according to the analysis result of the low-frequency band signal; and an addition unit to perform an inverse MLT on each of the signals, on which long-term prediction has been performed, and adding the signals on which the inverse MLT has been performed.

28. The apparatus of claim 23, further comprising:

an inverse quantization unit inversely quantizing the quantized signal;

an inverse transform unit inversely transforming the inversely quantized signal into a signal in a time domain; and a buffering unit buffering the signal in the time domain, wherein the LTP unit performs long-term prediction using the buffered signal.

29. An adaptive decoding apparatus comprising:

an inverse quantization/inverse transform unit inversely quantizing a quantized low-frequency band signal and inversely transforming the inversely quantized low-frequency band signal into a signal in a time domain;

a first synthesis unit, implemented by at least one processor, synthesizing a result of backward adaptive linear prediction or long-term prediction with the signal in the time domain if an encoding end has performed backward adaptive linear prediction or long-term prediction;

a second synthesis unit synthesizing a result of forward adaptive linear prediction of the encoding end with an output of the first synthesis unit; and a high-frequency band decoding unit decoding a high-frequency band signal using the result of long-term prediction or an output of the second synthesis unit.

30. The apparatus of claim 29, further comprising:

a buffering unit to buffer the signal in the time domain, wherein the first synthesis unit synthesizes the result of backward adaptive linear prediction or long-term prediction with the signal in the time domain using the buffered signal.

31. The apparatus of claim 29, wherein the first synthesis unit comprises:

a band splitting unit splitting the signal in the time domain into a plurality of bands using a plurality of band pass filters if the encoding end has performed long-term prediction;

an LTP synthesis unit synthesizing the result of long-term prediction of the encoding end with each band signal; and an addition unit adding signals output from the LTP synthesis unit.

32. The apparatus of claim 29, wherein the first synthesis unit comprises:

a band splitting unit splitting the signal in the time domain into a plurality of bands using a plurality of QMFs if the encoding end has performed long-term prediction;

an LTP synthesis unit synthesizing the result of long-term prediction of the encoding end with each band signal; and an addition unit performing inverse quadrature mirror filtering on each signal output from the LTP synthesis unit and adding the signals on which inverse quadrature mirror filtering has been performed.

33. The apparatus of claim 29, wherein the first synthesis unit comprises:

a band splitting unit to split the signal in the time domain into a plurality of bands using a plurality of FV-MLTs if the encoding end has performed long-term prediction;

an LTP synthesis unit to synthesize the result of long-term prediction of the encoding end with each band signal; and an addition unit to perform an inverse MLT on each signal output from the LTP synthesis unit and to add the signals on which the inverse MLT has been performed.

* * * * *